US010164380B2

(12) United States Patent
Regnier

(10) Patent No.: US 10,164,380 B2
(45) Date of Patent: Dec. 25, 2018

(54) COMPACT CONNECTOR SYSTEM

(71) Applicant: Molex, LLC, Lisle, IL (US)

(72) Inventor: Kent E. Regnier, Lombard, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/770,497

(22) PCT Filed: Feb. 27, 2014

(86) PCT No.: PCT/US2014/019076
§ 371 (c)(1),
(2) Date: Aug. 26, 2015

(87) PCT Pub. No.: WO2014/134330
PCT Pub. Date: Sep. 4, 2014

(65) Prior Publication Data

US 2016/0013596 A1 Jan. 14, 2016

Related U.S. Application Data

(60) Provisional application No. 61/770,027, filed on Feb. 27, 2013, provisional application No. 61/885,134, filed on Oct. 1, 2013.

(51) Int. Cl.

| | |
|---|---|
| ***H01R 13/6594*** | (2011.01) |
| ***H01R 12/58*** | (2011.01) |
| ***H01R 12/72*** | (2011.01) |
| ***H01R 13/514*** | (2006.01) |
| ***H01R 13/6587*** | (2011.01) |

(52) U.S. Cl.
CPC ..... *H01R 13/6594* (2013.01); *H01R 12/585* (2013.01); *H01R 12/724* (2013.01); *H01R 13/514* (2013.01); *H01R 13/6587* (2013.01)

(58) Field of Classification Search
CPC . H01R 13/6594; H01R 12/585; H01R 12/724
USPC ..... 439/607.35, 79
See application file for complete search history.

(56) References Cited

U.S. PATENT DOCUMENTS

| | | | | |
|---|---|---|---|---|
| 5,626,483 | A * | 5/1997 | Naitoh | H01R 13/035 29/884 |
| 6,814,619 | B1 | 11/2004 | Stokoe et al. | |
| 6,843,686 | B2 | 1/2005 | Ohnishi et al. | |
| 6,875,031 | B1 | 4/2005 | Korsunsky et al. | |
| 7,422,483 | B2 | 9/2008 | Avery et al. | |
| 7,524,209 | B2 | 4/2009 | Hull et al. | |
| 7,824,197 | B1 | 11/2010 | Westman et al. | |
| 7,976,318 | B2 | 7/2011 | Fedder et al. | |
| 8,033,840 | B2 | 10/2011 | Wang et al. | |

(Continued)

FOREIGN PATENT DOCUMENTS

| | | |
|---|---|---|
| JP | 2004-031334 A | 1/2004 |
| WO | WO 2004-095651 A1 | 11/2004 |

*Primary Examiner* — Abdullah Riyami
*Assistant Examiner* — Nader Alhawamdeh
(74) *Attorney, Agent, or Firm* — Jeffrey K. Jacobs

(57) ABSTRACT

A connector system is disclosed that is configured to provide terminals at a 0.5 mm pitch with providing for high data rates of 10 Gbps or more. In an embodiment, a 4X connector can be provided that is about the size of a convention SFP connector while still supporting relatively high data rates. This connector can be stacked to provide additional density.

15 Claims, 42 Drawing Sheets

(56) References Cited

U.S. PATENT DOCUMENTS

| | | | | |
|---|---|---|---|---|
| 8,449,312 | B2 * | 5/2013 | Lang | H01R 9/038 439/352 |
| 8,540,525 | B2 * | 9/2013 | Regnier | H01R 29/00 439/79 |
| 8,591,260 | B2 | 11/2013 | Davis et al. | |
| 8,740,644 | B2 * | 6/2014 | Long | G02B 6/0001 439/541.5 |
| 2008/0088331 | A1 * | 4/2008 | Yoshida | G01R 1/0466 324/755.05 |
| 2009/0011620 | A1 | 1/2009 | Avery et al. | |
| 2011/0300757 | A1 * | 12/2011 | Regnier | H01R 29/00 439/626 |
| 2014/0194004 | A1 * | 7/2014 | Pickel | H01R 13/648 439/607.01 |
| 2016/0013596 | A1 * | 1/2016 | Regnier | H01R 12/585 439/607.35 |

* cited by examiner

COMPACT CONNECTOR SYSTEM

RELATED APPLICATIONS

This application is a national phase of PCT Application No. PCT/US2014/019076, filed Feb. 27, 2014, which in turn claims priority to U.S. Provisional Application No. 61/770,027, filed Feb. 27, 2013 and to U.S. Provisional Application No. 61/885,134, filed Oct. 1, 2013, both of which are incorporated herein by reference in their entirety.

FIELD OF THE INVENTION

The present invention relates to the field of connectors, more specifically to the field of connectors suitable for use with high data rates.

DESCRIPTION OF RELATED ART

A number of connector types are available for data communication. Popular examples include small form-factor pluggable (SFP) and quad small form-factor pluggable (QSFP) style connectors. One issue that has become increasingly problematic is the desire for density. Well design SFP style connectors with an SMT configuration, for example, are capable of supporting data rates of 16 Gbps using non-return to zero (NRZ) encoding and can be positioned in a ganged configuration where each connector takes up about 12.25 mm of board space and there is 2 mm of keep out space between adjacent connectors (thus the connectors can be considered to be on a 14.25 mm pitch). As each SFP provides one transmit and one receive sub-channel, SFP connectors are considered a 1X connector and thus ganged SFP connectors provide 1X channel each 14.25 mm of board space. QSFP connectors in a SMT configuration have a somewhat higher density and can provide four transmits and four receive sub-channels (e.g., a QSFP is a 4X connector) in a space that is about 22.25 mm wide. QSFP connectors in an SMT configuration can readily support data rates of 10 Gbps with NRZ encoding. SMT configurations, however, are not well suited to high port density. Of course, SMT connectors can be mounted in a belly-to-belly configuration but that requires mounting connectors on both sides of a supporting circuit board. Therefore, certain individuals prefer stacked connectors.

Stacked connectors provide a more challenging design situation. The footprint of a stacked connector tends to be less suited for SMT style tails due to the difficulty of inspecting the solder joints and for many customers a connector with a press-fit style tail is more desirable. Press-fit configurations are more challenging to provide suitable performance at higher data rates, in part because of the connector-to-circuit board interface. In addition, the upper ports tend to be more glossy while the lower ports tend to resonate more and these issues are exacerbated by the fact that there are additional signal pairs, which increases the cross talk. Thus, while it is possible to provide press-fit stacked QSFP and SFP style connectors that can support 10 Gbps or even 16 Gbps data rates, such connectors become more complicated and challenging to develop and manufacture. And even with the increased data rates, there exists further desire for even greater port density. Thus, certain individuals would appreciate further improvements in port density while maintaining performance levels suitable for supporting 10 Gbps data rates.

BRIEF SUMMARY

A press-fit connector is provided that offers back routing, even in a stacked connector. In an embodiment the connector tails can be configured in angled rows so that traces can extend from a mating side of the connector a rear side of the connector. In an embodiment the connector includes an upper card slot and a lower card slot and the terminals in each card slot can be on a 0.5 mm pitch. In an embodiment, each of the upper and lower card slot are configured to provide four transmit and four receive sub-channels (e.g., a 4X connector) while the connector housing can be about 14 mm wide. In an embodiment, each sub-channel is configured to support 10 Gbps data rates in an NRZ encoding. The connector can include pairs of wafer sets that are configured to provide higher data rates (such as the 10 Gbps data rate) with shield plates positioned on each side of the wafer sets and two shield plates can be positioned between adjacent wafer sets.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may he combined together to form additional combinations that were not otherwise shown for purposes of brevity.

Figure 1:
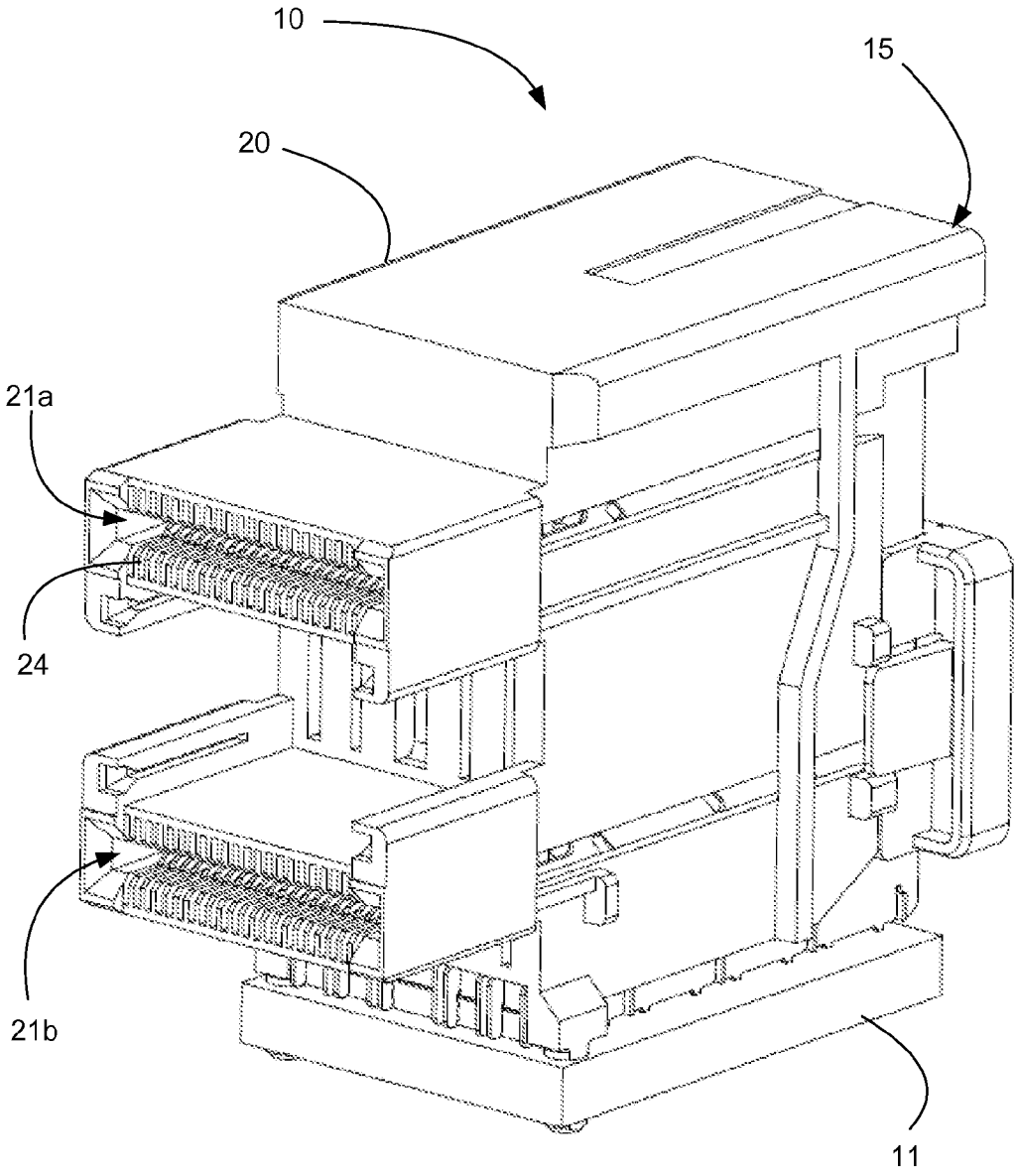
FIG. 1 illustrates a perspective view of an embodiment of a stacked connector system.
Figure 2:
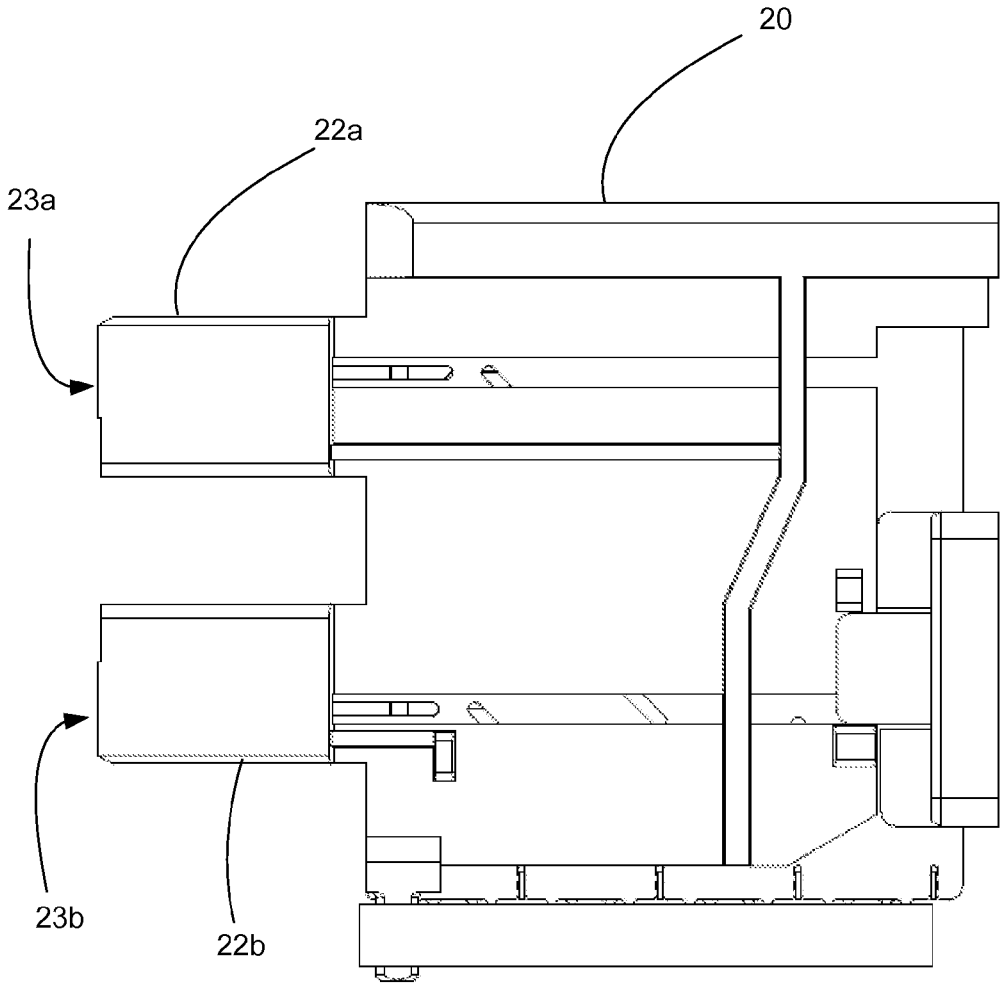
FIG. 2 illustrates an elevated side view of the connector system depicted in FIG. 1.
Figure 3:
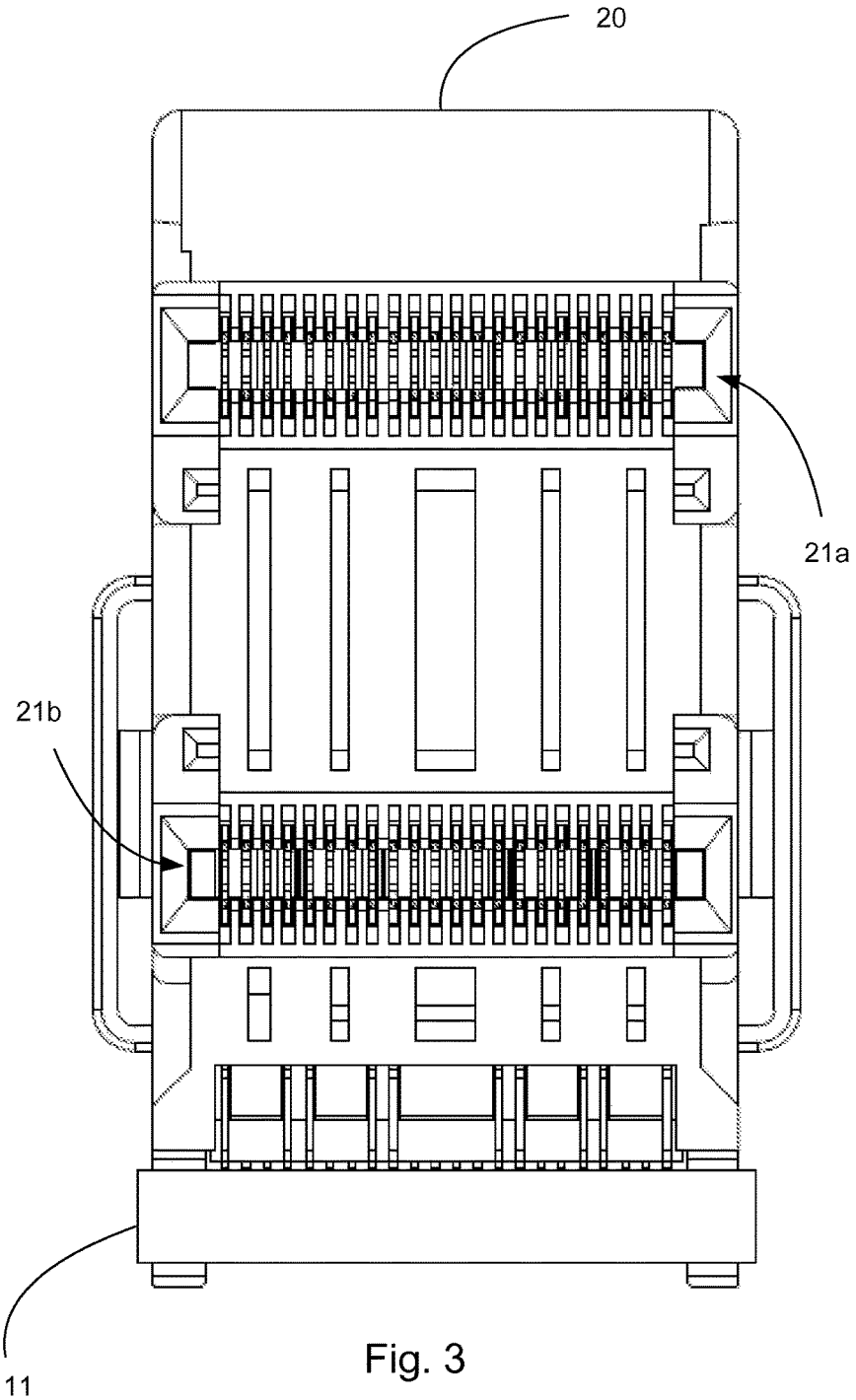
FIG. 3 illustrates an elevated front view of the connector S stem depicted in FIG. 1.
Figure 4:
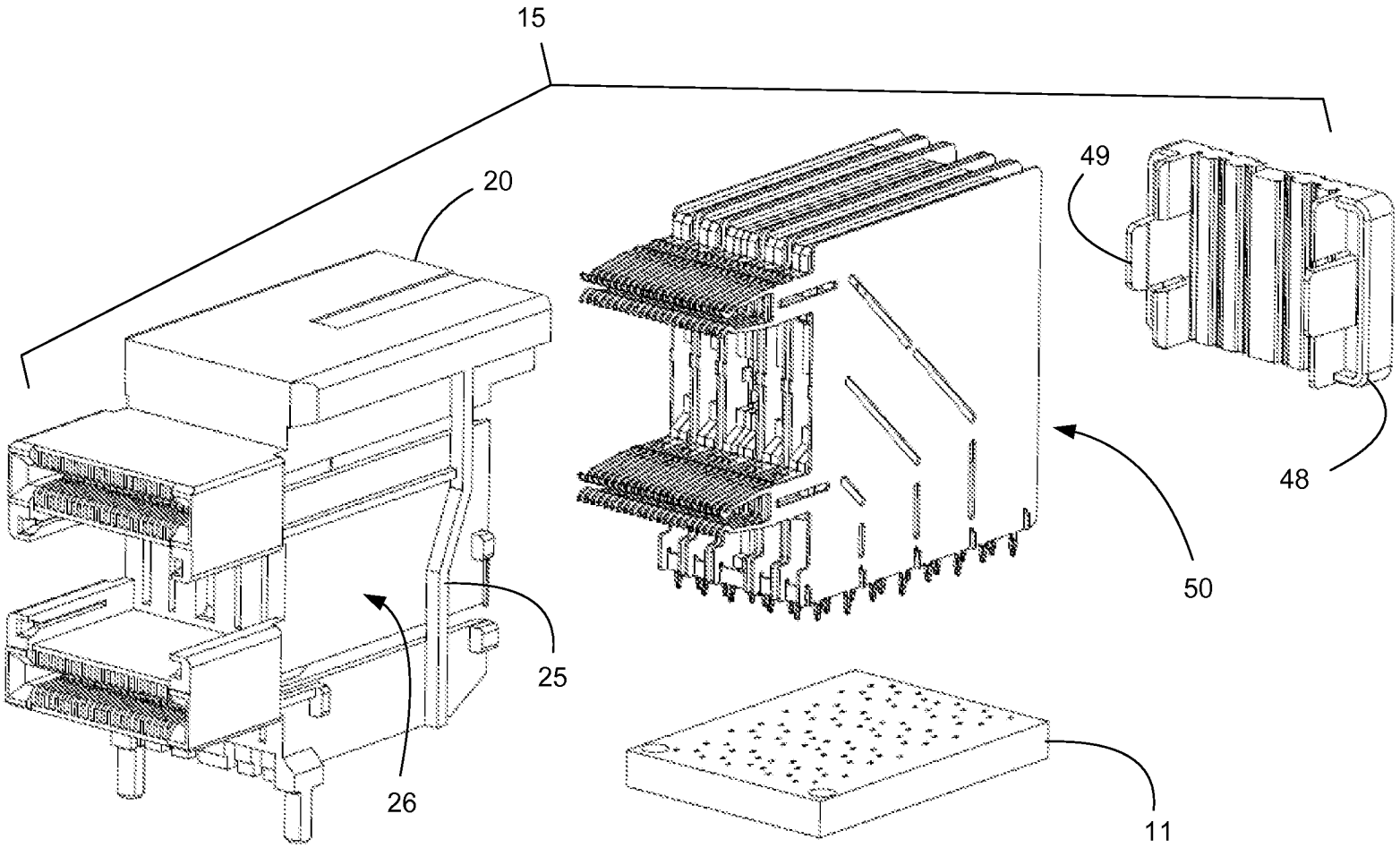
FIG. 4 illustrates a perspective exploded view of an embodiment of a connector system.
Figure 5:
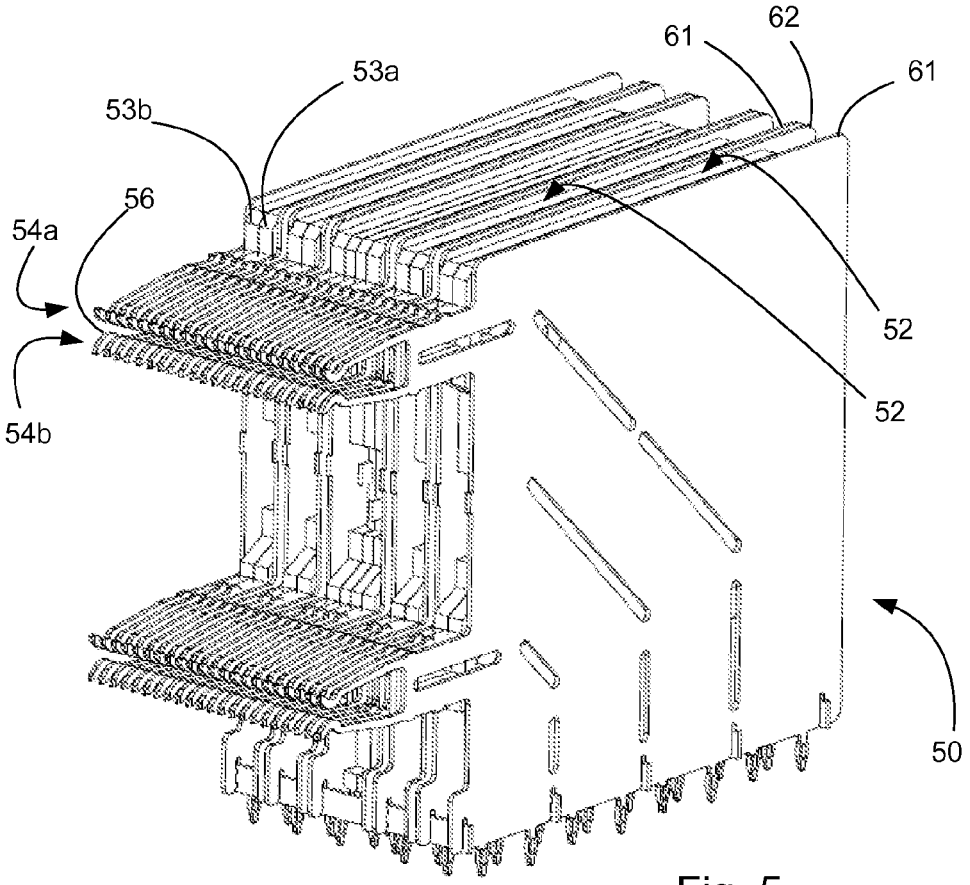
FIG. 5 illustrates a perspective view of an embodiment of a wafer group.
Figure 6:
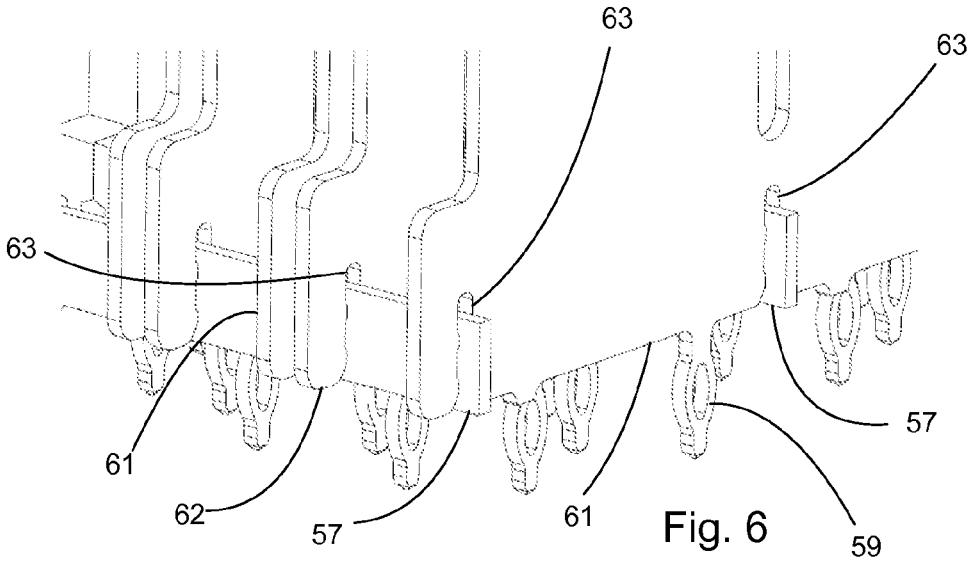
FIG. 6 illustrates a perspective enlarged view of the embodiment depicted in FIG. 5.
Figure 7:
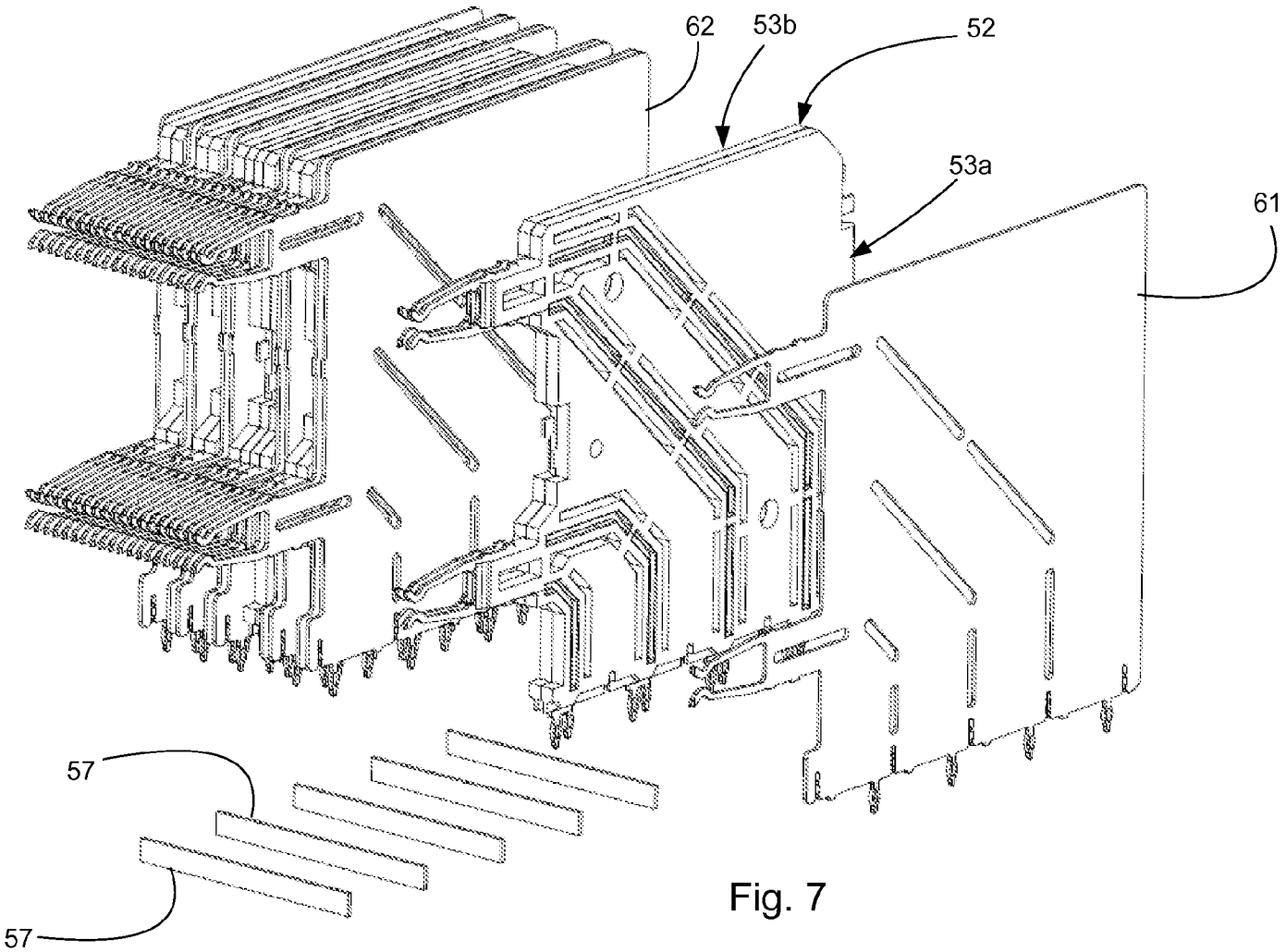
FIG. 7 illustrates a perspective exploded view of the embodiment depicted in FIG. 5.
Figure 8:
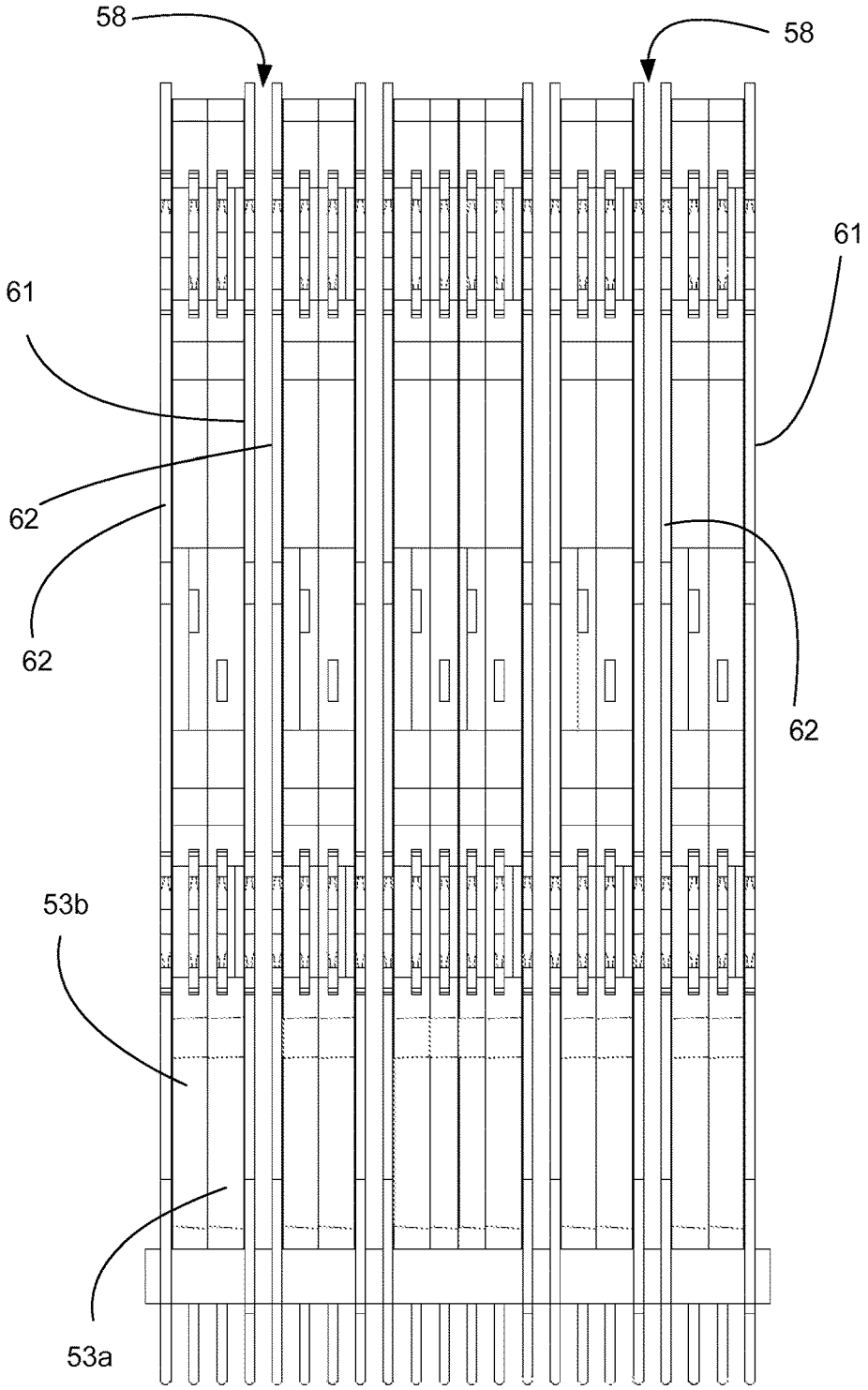
FIG. 8 illustrates an elevated front view of an embodiment of a wafer group.
Figure 9:
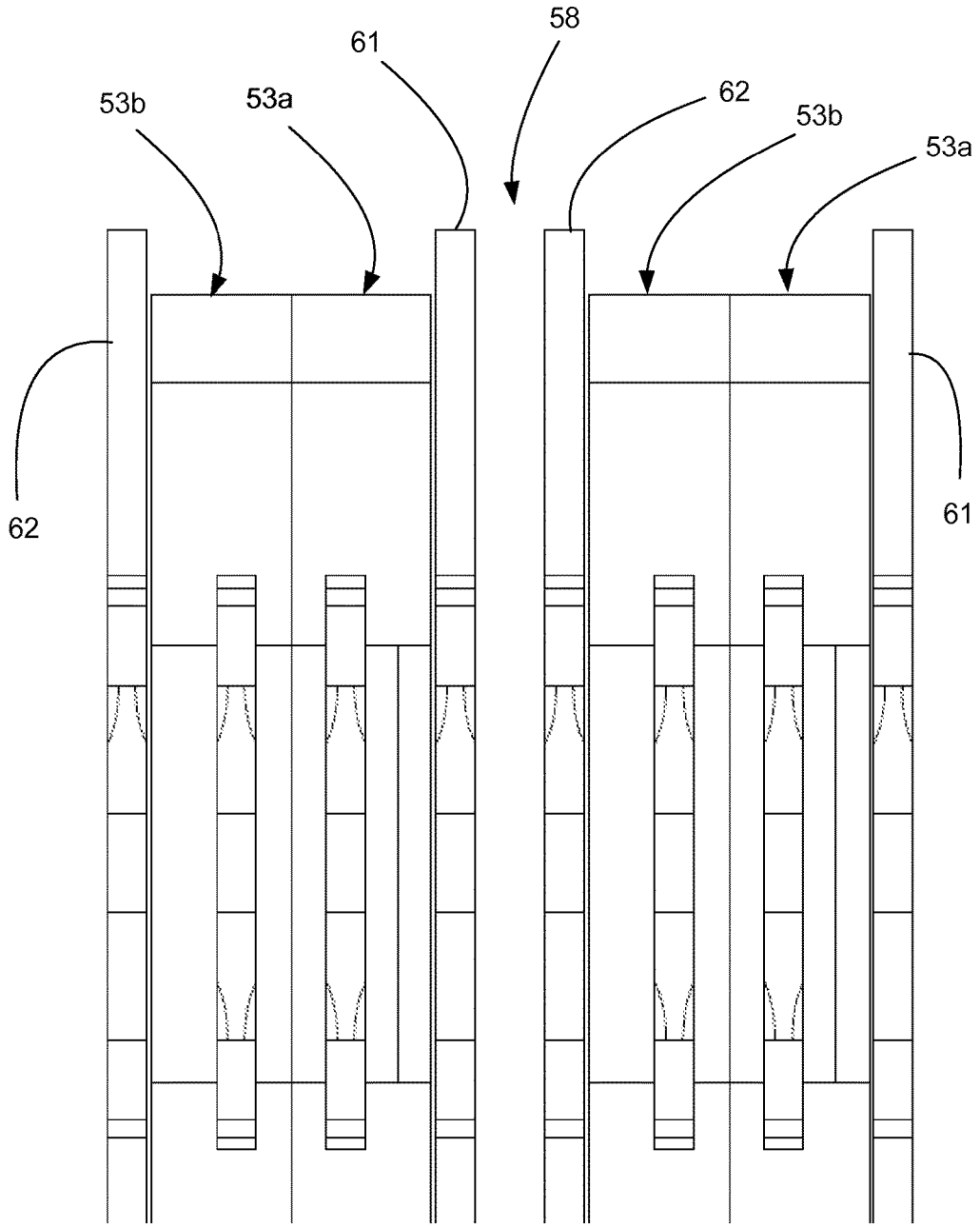
FIG. 9 illustrates an enlarged view of the embodiment depicted in FIG. 8.
Figure 10:
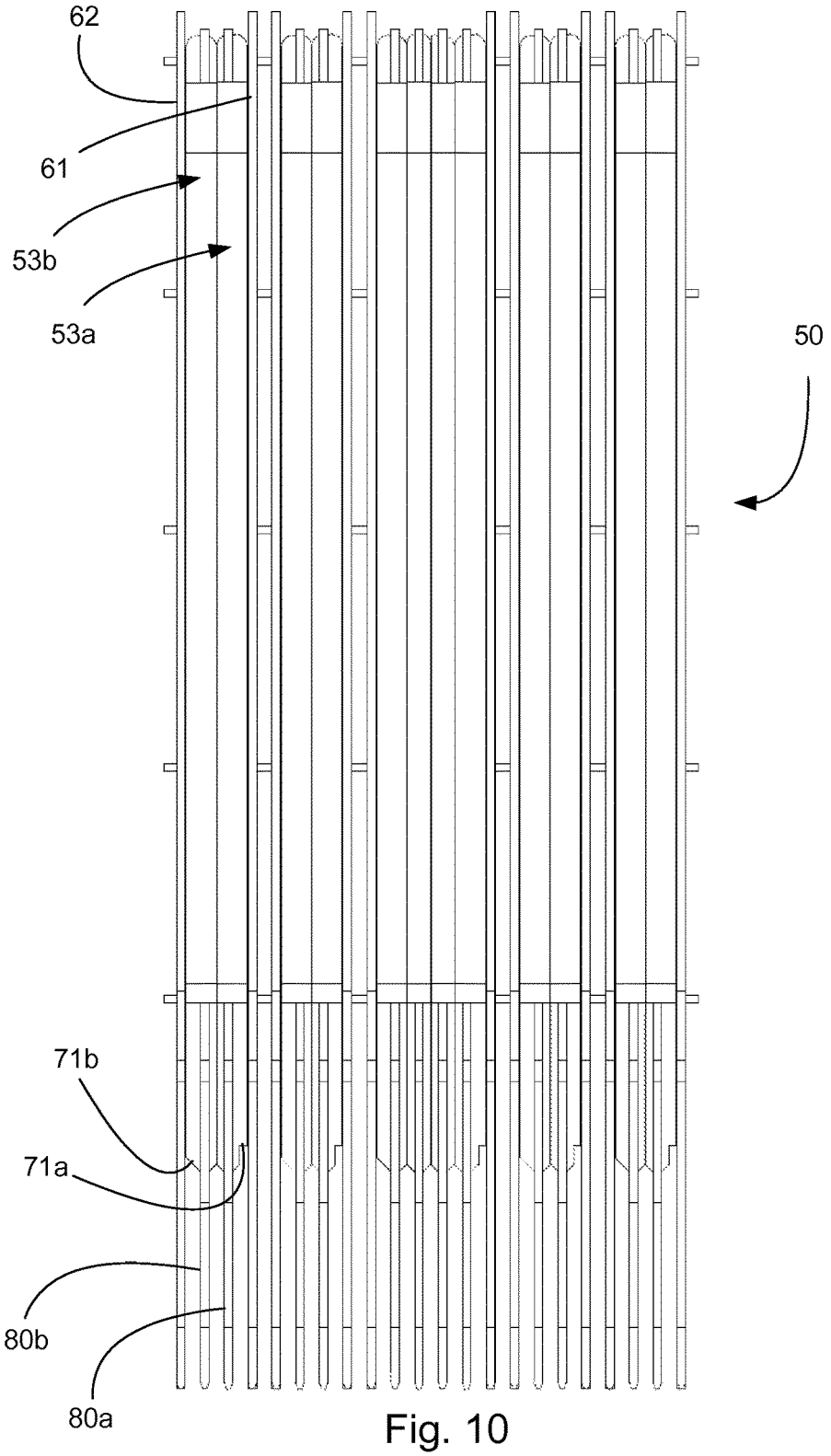
FIG. 10 illustrates a plan view of the embodiment depicted in FIG. 8.
Figure 11:
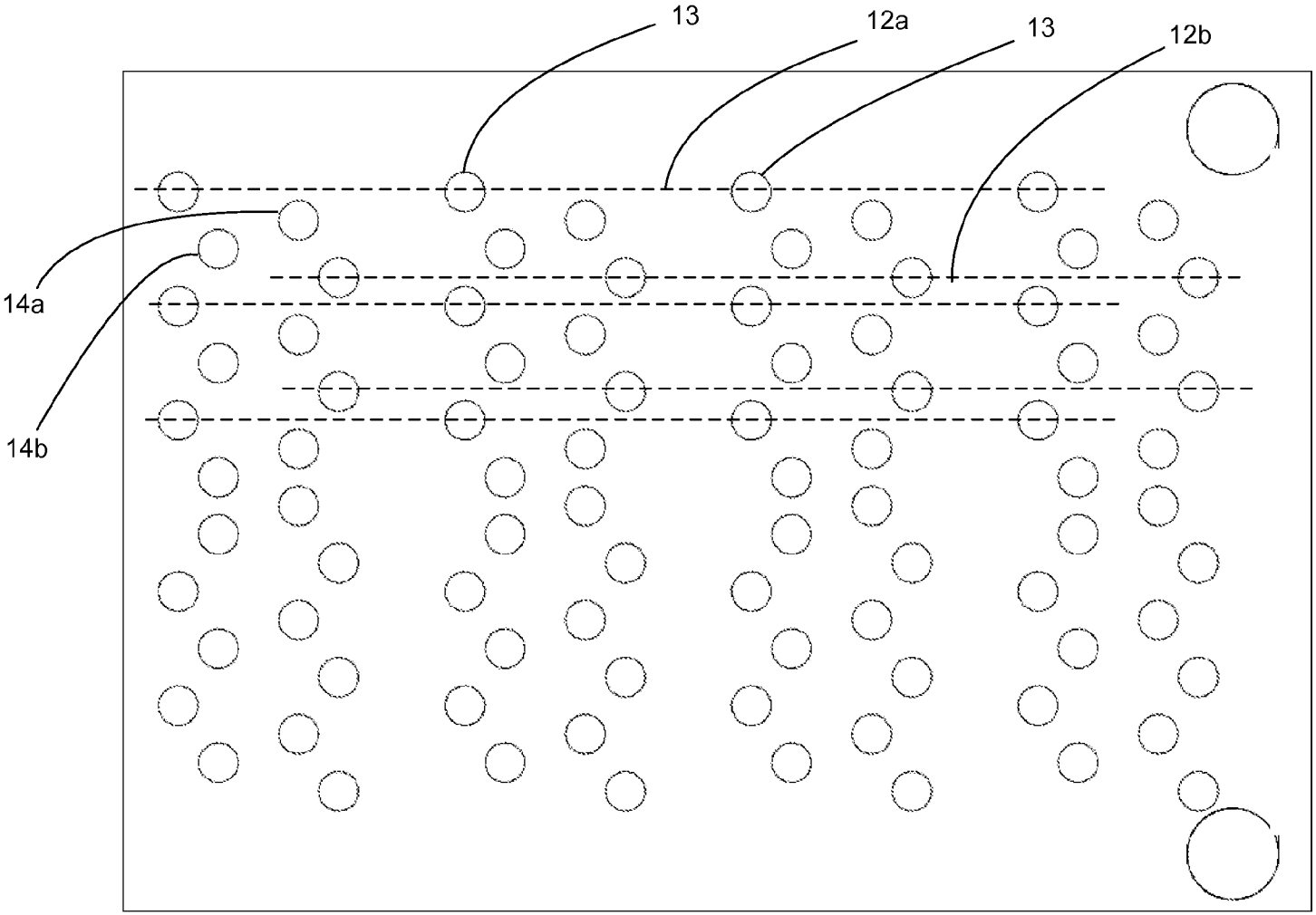
FIG. 11 illustrates a plan view of an embodiment of a circuit hoard.
Figure 12:
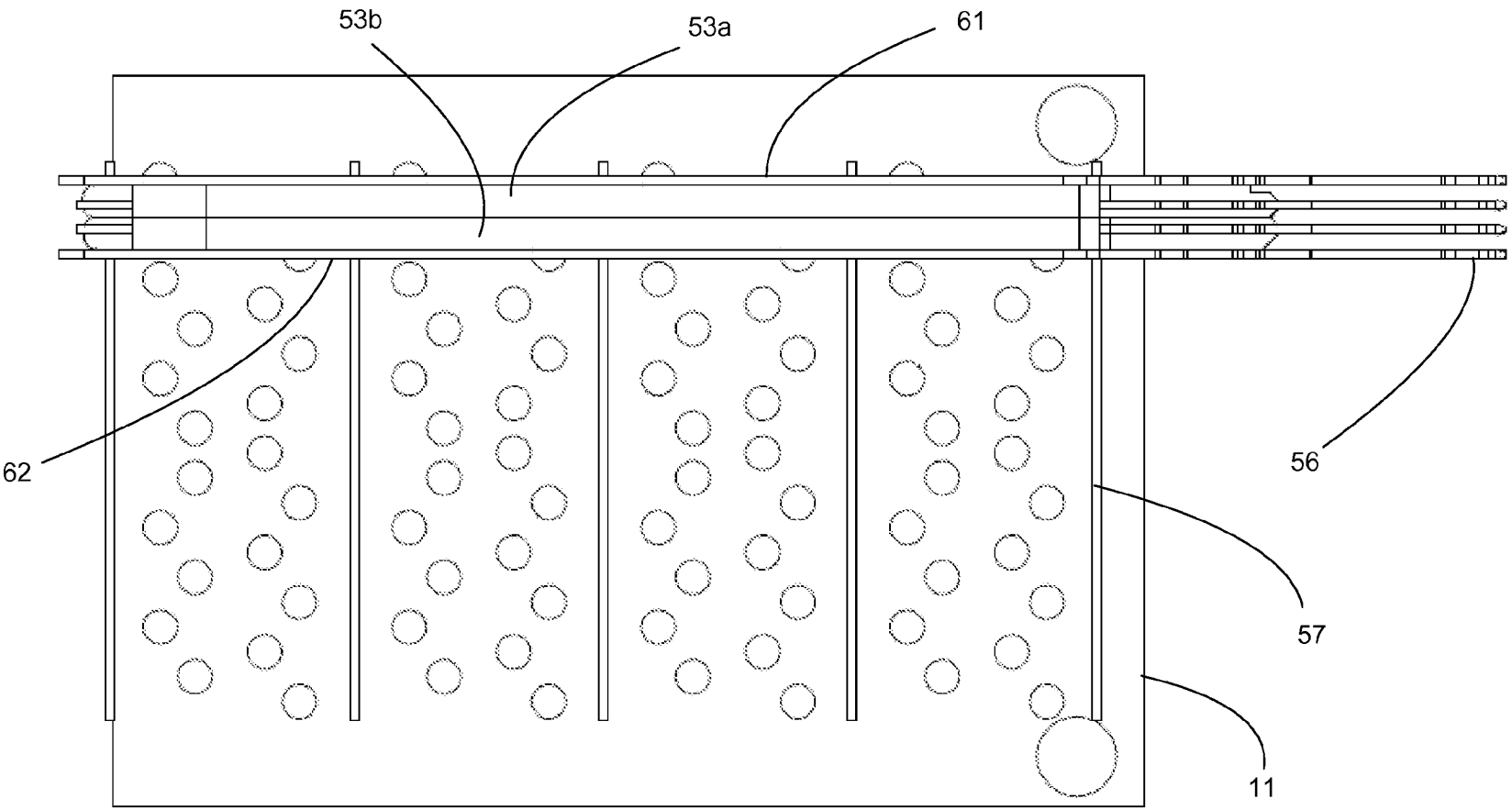
FIG. 12 illustrates a plan view of a portion of a wafer group positioned on a circuit hoard.
Figure 13:
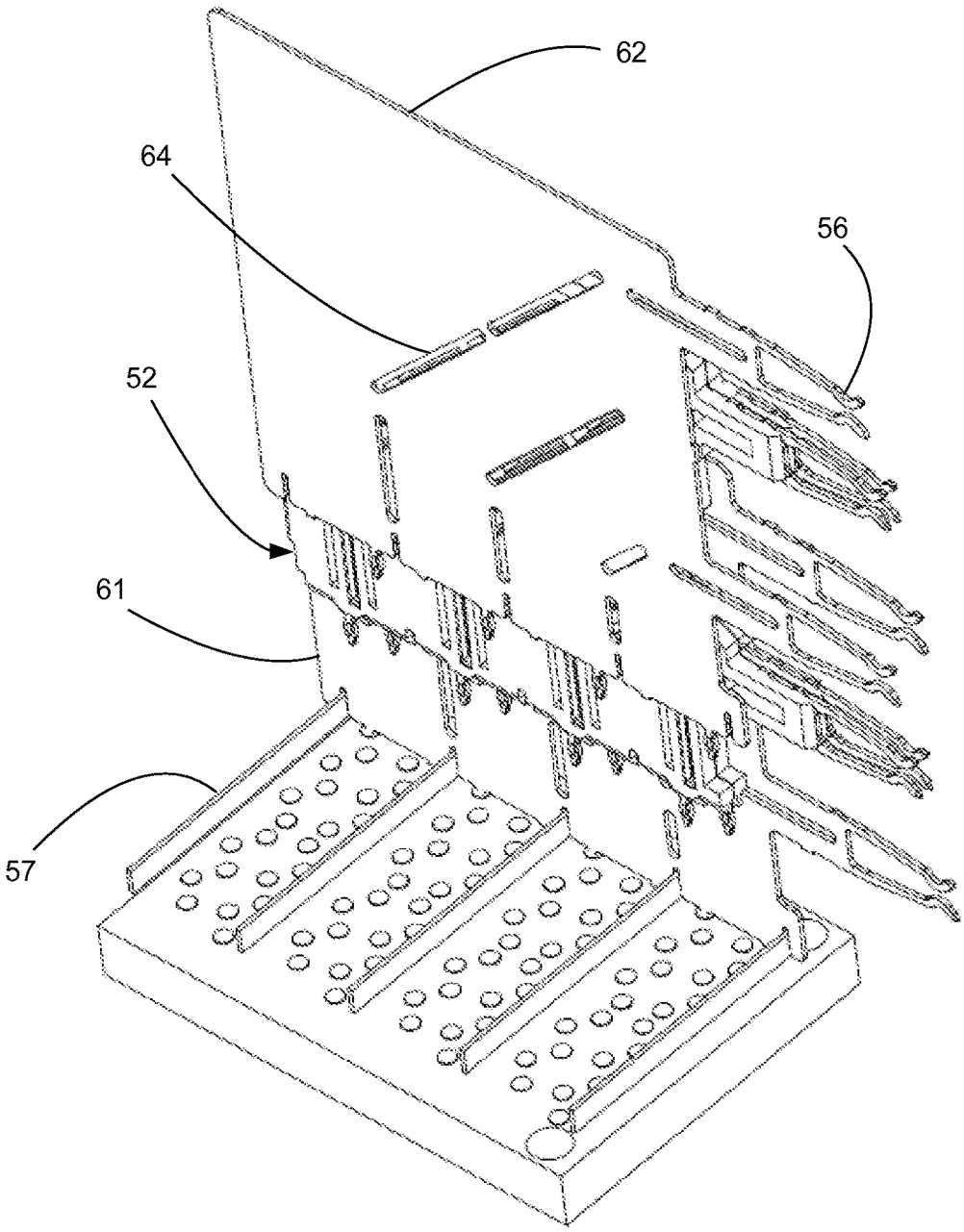
FIG. 13 illustrates a perspective, partially exploded view of the embodiment depicted in FIG. 12.
Figure 14:
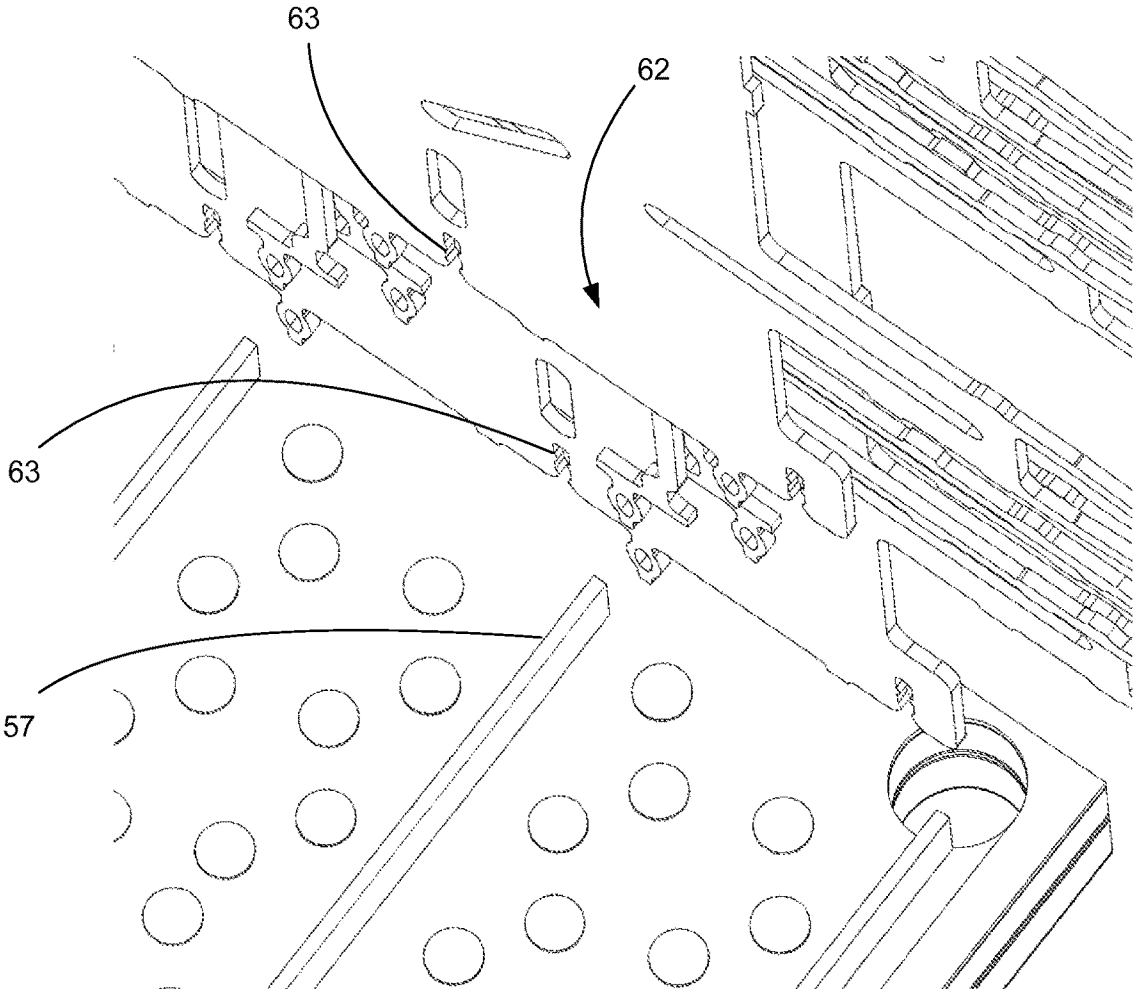
FIG. 14 illustrates an enlarged perspective exploded view of an embodiment of a portion of a wafer group.
Figure 15:
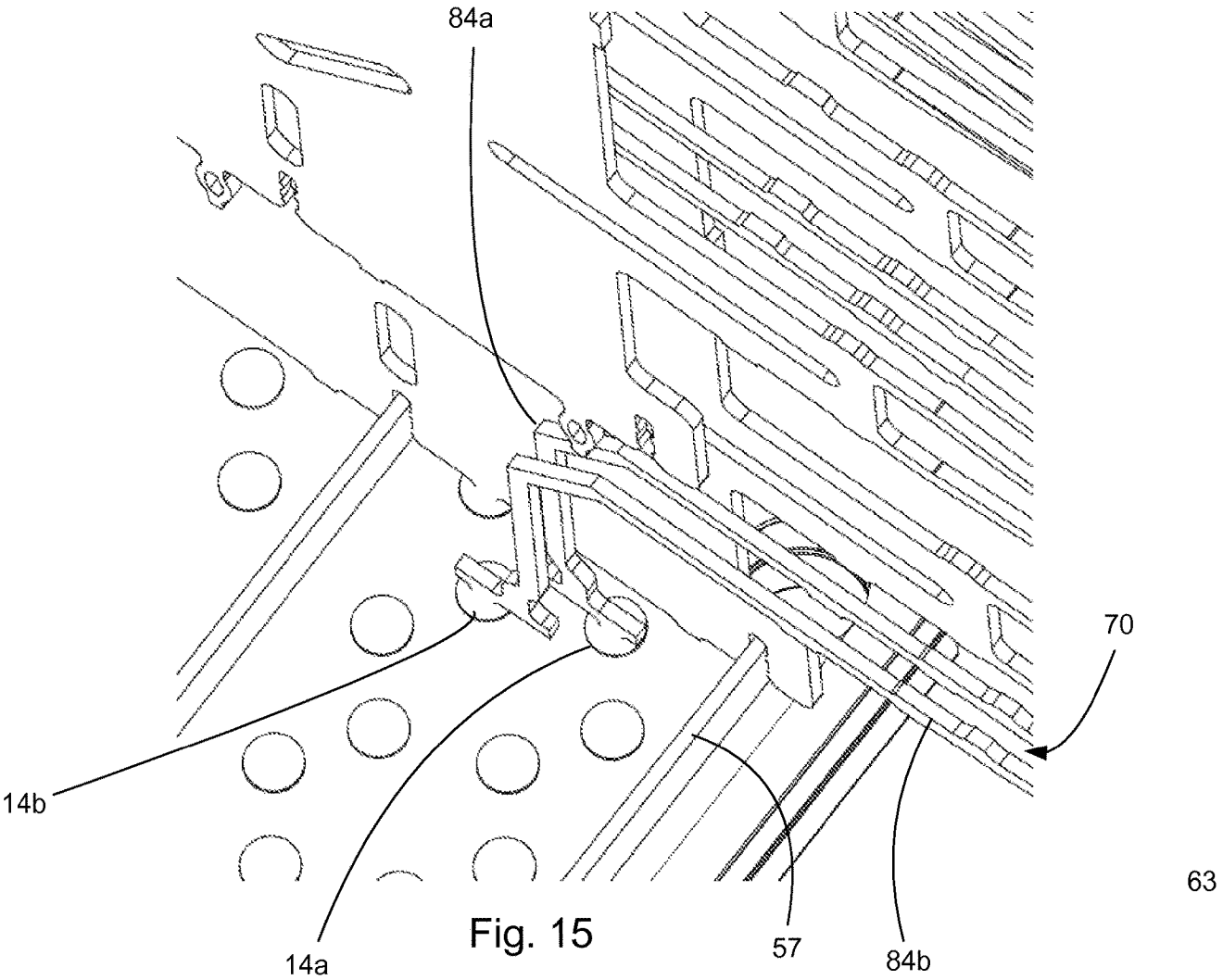
FIG. 15 illustrates a perspective view of an embodiment similar to that depicted in FIG. 14 but with signal terminal in a different position.

FIGS. 1-15 illustrate details of exemplary embodiment of a stacked connector. As can be appreciated, the depicted connector embodiments relate to a right-angle connector suitable for providing high port density. In addition, the connector is shown in a stacked configuration. As can be appreciated, a smaller version could be provided that was not stacked (e.g., a press-fit design with a single port) by removing the top or bottom port. In alternative embodiments a similar connector can be provided where one or more ports are positioned in a vertical configuration (such a connector can be horizontally stacked or not, for example, depending on whether one or two ports are included). Thus, a number of variations are possible and contemplated as being within the scope of the disclosure.

Looking at FIGS. 1-15, a connector system 10 includes a connector 15 mounted on a circuit board 11. The connector 15 includes a housing 20 that supports a wafer group 50 and provides card slots 21*a*, 21*b* and terminal grooves 24 are provided on both sides of the card slots 21*a*, 21*b*. The card slots are positioned in projections 22*a*, 22*b*, which respectively include a front face 23*a*, 23*b*. An end cap 48 is secured to the housing 20 with arms 49 and helps hold the housing 20 and wafer group 50 in the desired position relative to each other.

The wafer group 50 includes a plurality of shield plates 61, 62 and a plurality of wafer sets 52 positioned between shield plates 61, 62. Each wafer set 52 includes a first wafer 53*a* and a second wafer 53*b*. The wafer sets 52 and the corresponding shield plates 61, 62 provide rows 54*a*, 54*b* of contacts 56 that are configured to be position in both sides of the card slots 21*a*, 21*b*. To provide additional performance, a common bar 57 is electrically connected to the shield plates 61, 62. As depicted, for example, the common bar 57 can be positioned in grooves 63 provided in the shield plates 61, 62. This has the benefit of both securing the common bar 57 in position and also ensuring a good electrical connection is made to each of the corresponding shield plates 61, 62 (e.g., the common bar 57 electrically connects the shield plates). It should be noted that as depicted, the common bar 57 extends across all the shield plates 61, 62 provided in wafer group 50. In an alternative embodiment the common bar 57 could extend across some portion of the shield plates 61, 62(e.g., 2 or more).

As can be appreciated, in the depicted embodiment the common bars 57 are provided on two sides of the tails 59 that fibrin the signal pair. While not required, it has been determined that it is beneficial to provide the common bars 57 on both sides of the signal terminals so as to provide a more balanced system, thus for certain embodiments it will be helpful to have one more common bar 57 than the number of differential pairs supported by the wafer set 52. Thus, for a stacked connector the wafer set could support four differential pairs and it would be desirable to have 5 common bars so that a common bar was positioned on opposing sides of each differential pair.

It should be noted that while the depicted embodiment includes common bars 57 positioned only in the mounting interface, other embodiments are contemplated. The benefit of the depicted embodiment is ease of assembly of the common bar 57 to the wafer group 50 and it appears to provide the largest benefit for a connector from a performance versus cost standpoint. Additional common bars could be positioned in a middle portion of the wafer group 50 (for example, by having apertures in the wafers and shield plates as is known). And if desired, the common bar could be either removed altogether or only positioned in the body of the connector (e.g., not provided in the mounting interface if it was determined undesirable to have a common bar in the mounting interface). Thus, the location and use of the common bar 57 is not intended to be limiting unless otherwise noted.

As can be appreciated, the shield plates 61, 62 are configured to replace wafers that conventionally would support a ground terminal. This is in part because Applicant has determined that removing the frame that would be used to support the ground terminals offers package benefits (e.g., it is easier to package the terminals). However, the shield plates 61, 62 still can be configured to provide tails 59 and contacts 56 so as to be equivalent to convention wafers that support ground terminals. One benefit of the depicted design is that all the ground terminals that would normally be separate terminals in a wafer construction are commoned together. Of course, at a 0.5 mm pitch it would be more difficult to have the increased amount of shielding provided by the shield plates 61, 62 and also include the institutive wafer.

Because of the use of double ground terminals (and double shield plates 61, 62) between wafer sets 52 that are configured to provide differential pairs 70 that are capable of supporting high data rates, additional electrical isolation is provided between adjacent differential pairs 70. This isolation is further enhanced by gap 58 that is provided between adjacent shield plates. This isolation has been determined to be beneficial when attempting provide higher data rates (such as 10 Gbps) over connectors at a pitch that is less than (16 mm.

It should be noted that the footprint used in the embodiment depicted FIGS. 1-15 is beneficial to providing the desired performance. On a 0.5 mm pitch it becomes impossible to have via holes for the terminals aligned side-by-side because the vias would overlap. In addition, certain features that function appropriately in a connector that has a 0.8 mm pitch do not function as desired in a connector that provides a 0.5 mm pitch and these issues are further complicated when attempting to provide a connector that is suitable for use at data rates of 10 Gbps (or more). For example, the need to offset the vias creates a number of electrical complications when seeking to provide 10 Gbps in a NRZ system. Existing connectors that have a pitch less than 0.6 mm (e.g., having a pitch that is 0.5 mm or less) cannot provide data rates approaching 5 Gbps per differential pair. The disclosed configuration has been determined to help resolve electrical issues that would otherwise he provided by the interface between the connector and the board while also allowing the connector to provide the desired insertion loss and cross-talk levels at and above the Nyquist frequency and supports 10 Gbps data rates.

The resultant design provides for a circuit board that supports rows 12*a*, 12*b* oaf vias 13 on opposing sides of vias 14*a*, 14*b* that act as signal vias. As can be appreciated, the common bar 57 thus helps connect the rows.

One issue with having a shield plate that acts as a common ground plate for all the signal pairs supported by a wafer set is that certain unintended modes will be developed on the shield plates due to electrical signals passing through the differential pair (and the coupling that occurs between the signal terminals and the shield plate). These unintended modes can propagate through the shield plates and create noise on other differential pairs. To help minimize such propagation of energy, slots 64 in the shield plates 61, 62 can be used to increase the impedance between the regions of the shield plate associated with different differential pairs and help ensure that more of the energy due to the unintended modes is dissipated. Thus, energy in the shield plates created by signals passing through terminals 80*a*, 80*b* (that form a differential pair 70) will be less likely to be perceived, for example, by terminals 84*a*, 84*b* that form another differential pair 70.

Figure 16:
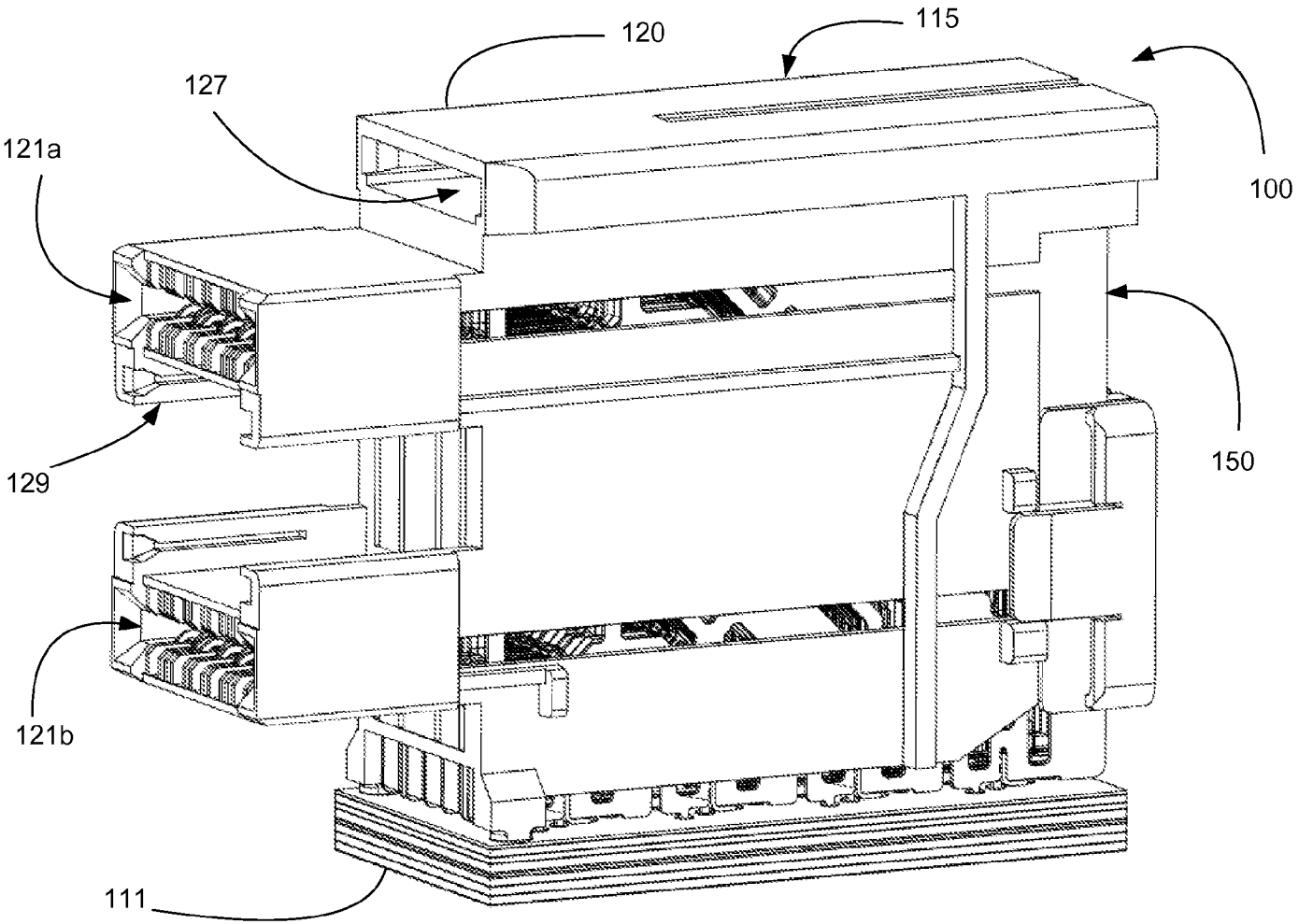
FIG. 16 illustrates a perspective view of another embodiment of a connector system.
Figure 17:
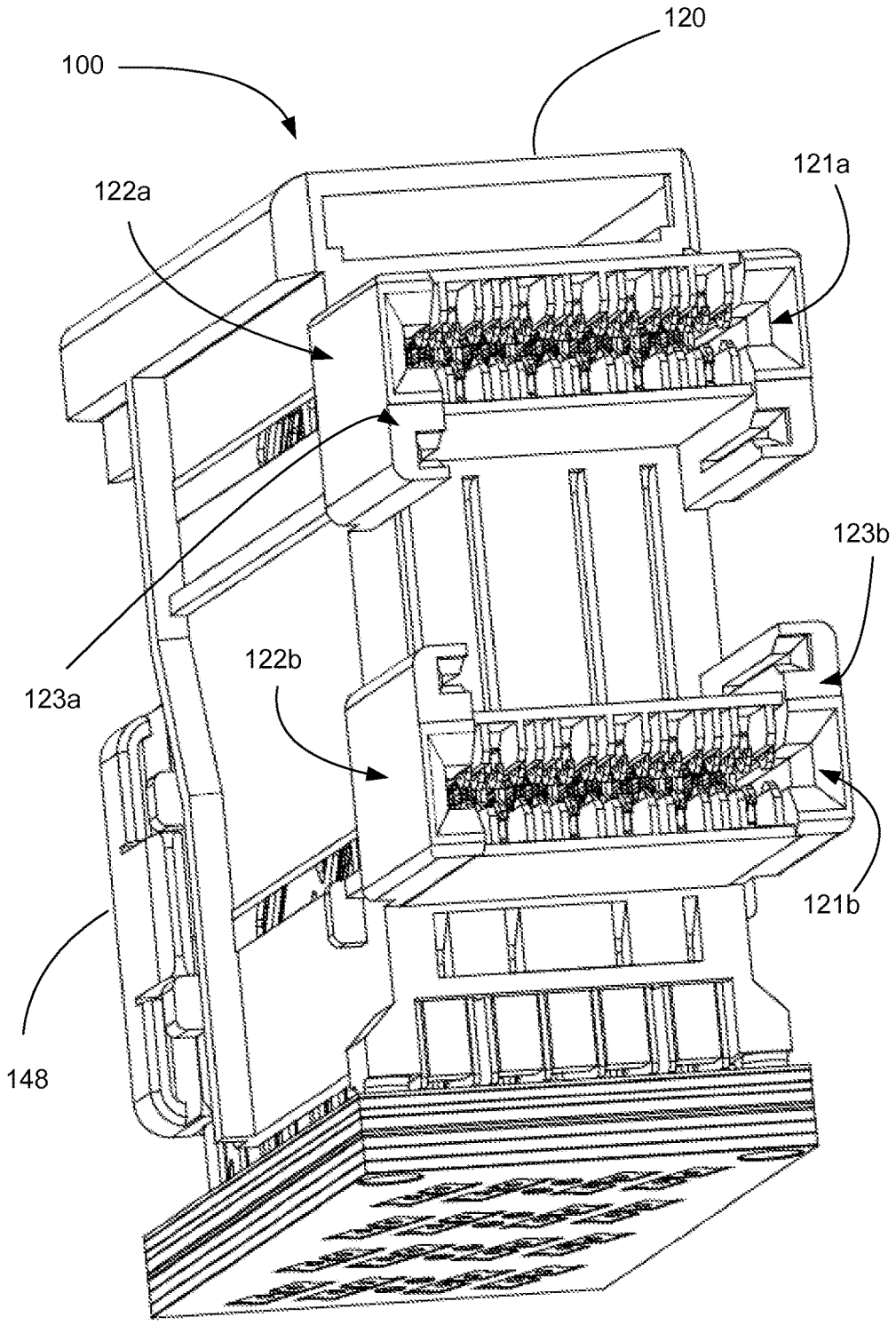
FIG. 17 illustrates another perspective view of the embodiment depicted in FIG. 16.
Figure 18A:
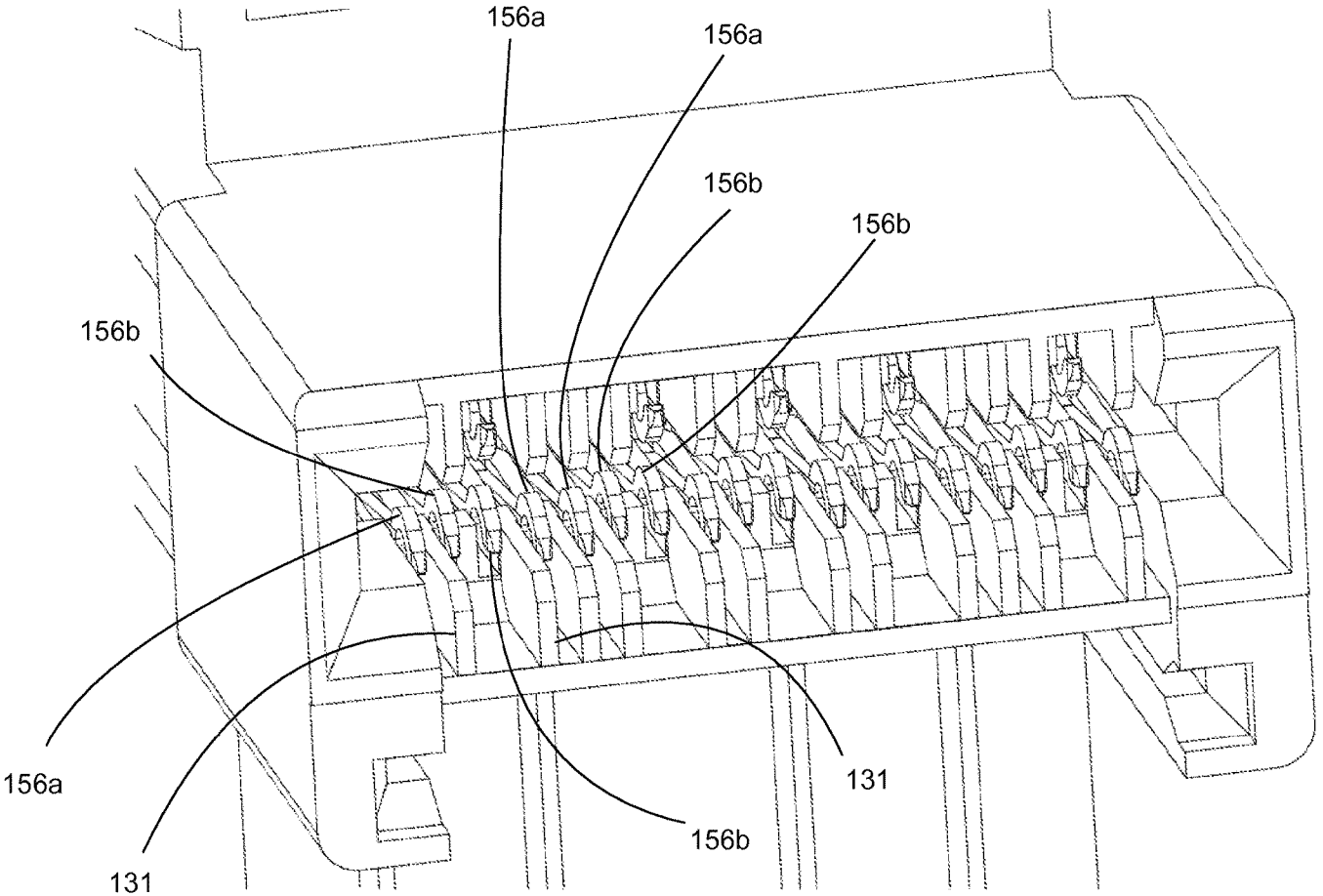
FIG. 18A illustrates a perspective simplified view of an embodiment of a card slot.
Figure 18B:
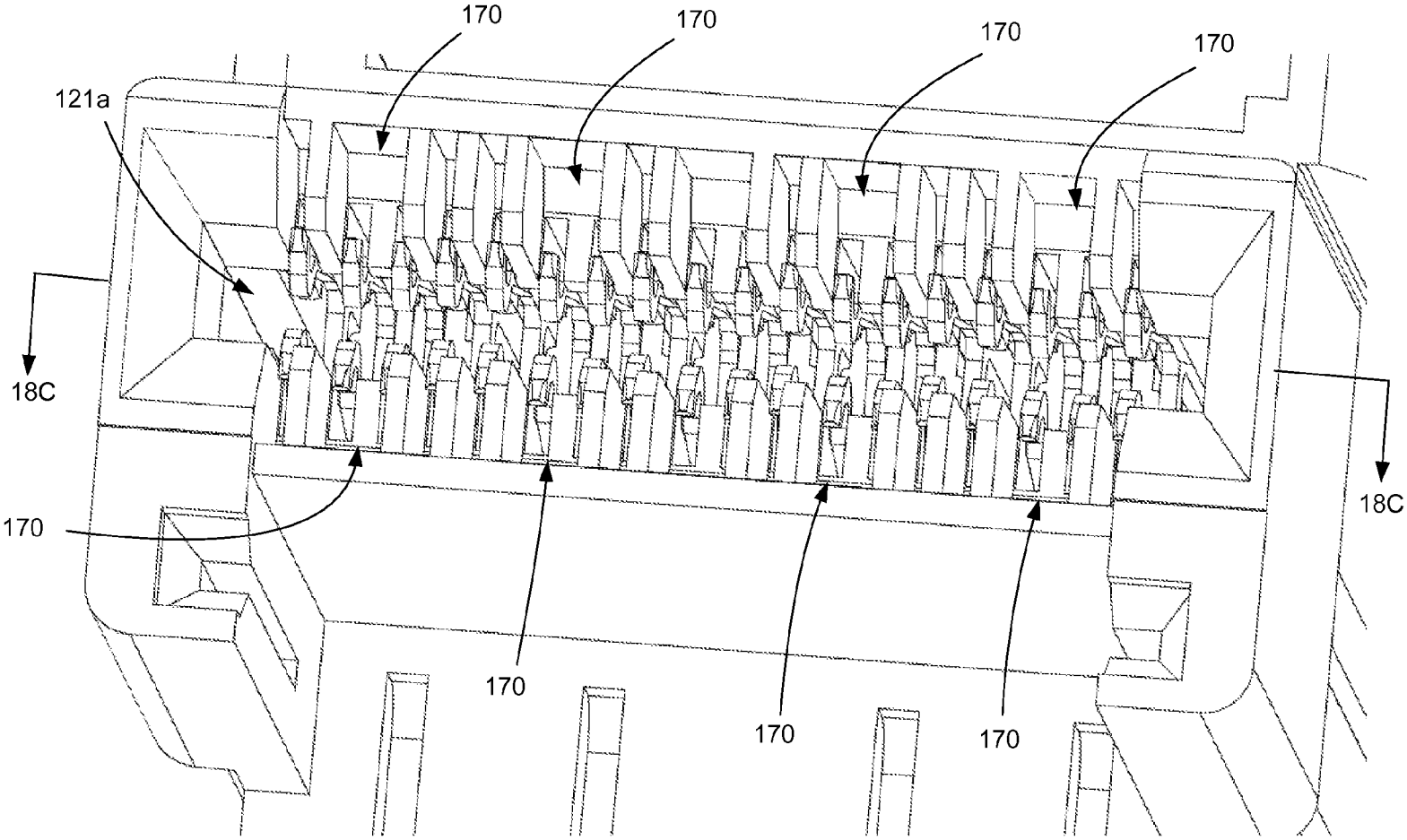
FIG. 18B illustrates a perspective enlarged view of a card slot depicted in FIG. 17.
Figure 18C:
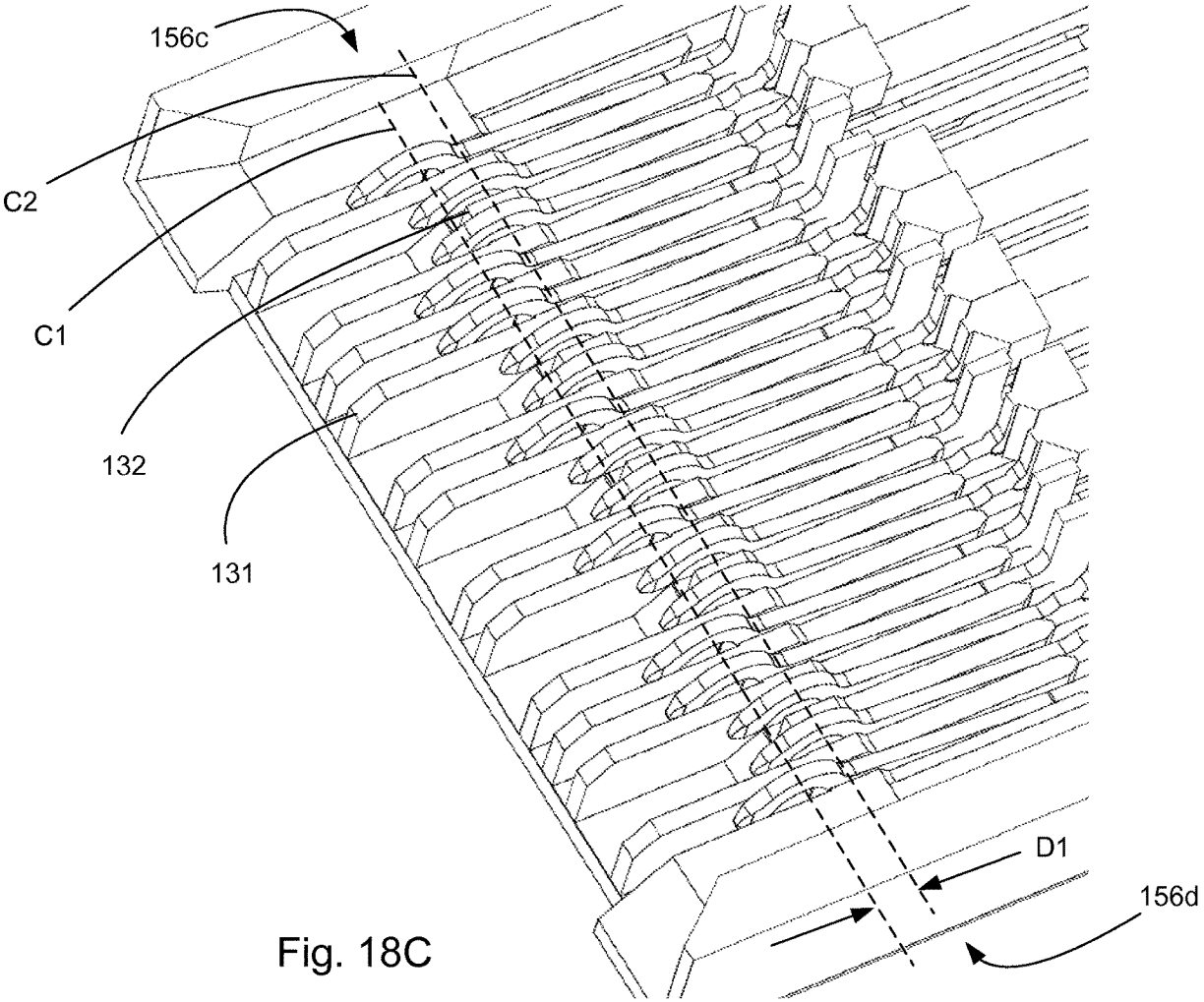
FIG. 18C illustrates a perspective view of a cross section taken along the line 18C-18C in FIG. 18B.
Figure 19:
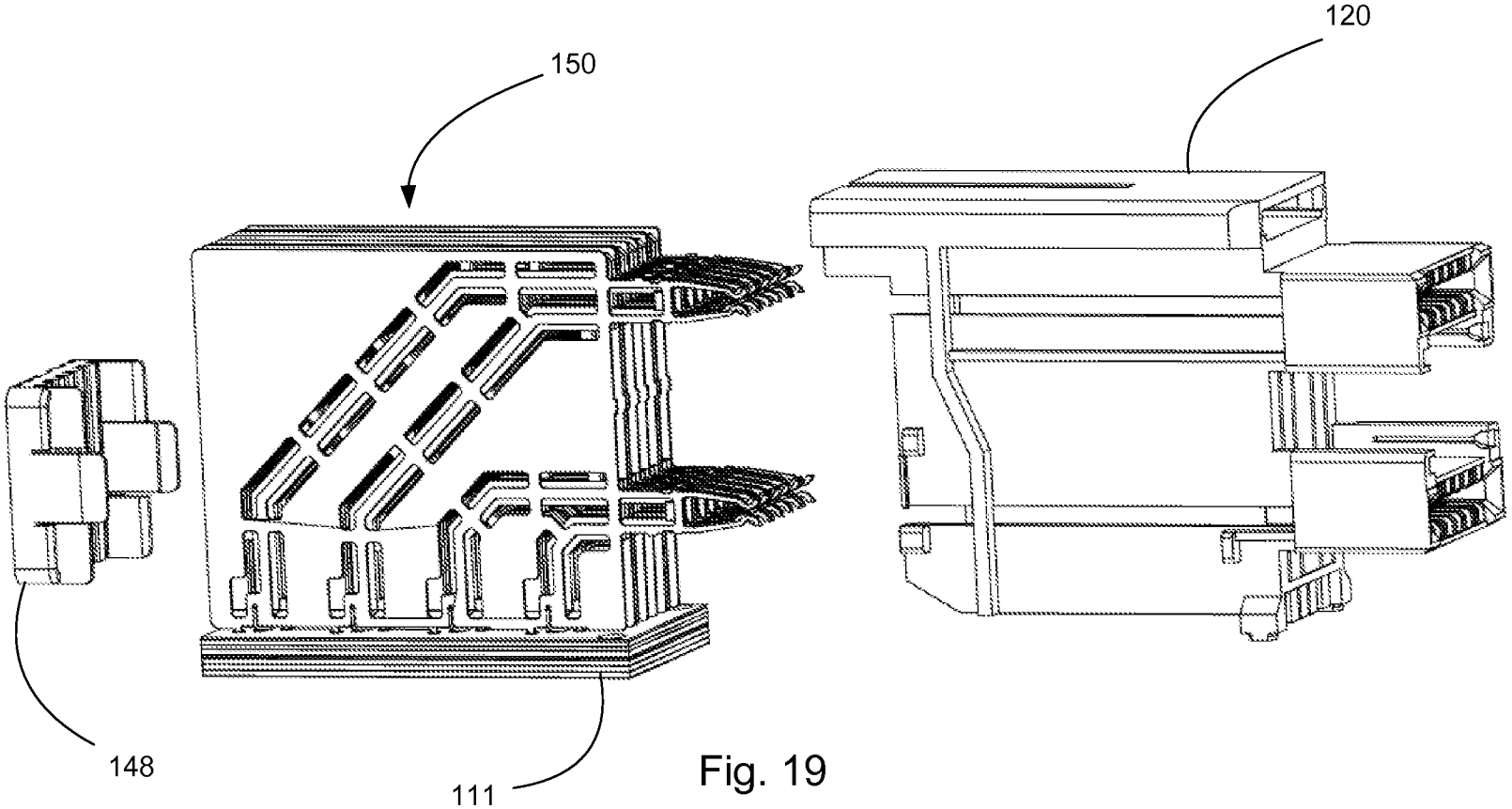
FIG. 19 illustrates a perspective partially exploded view of an embodiment of the connector system depicted in FIG. 16.
Figure 20:
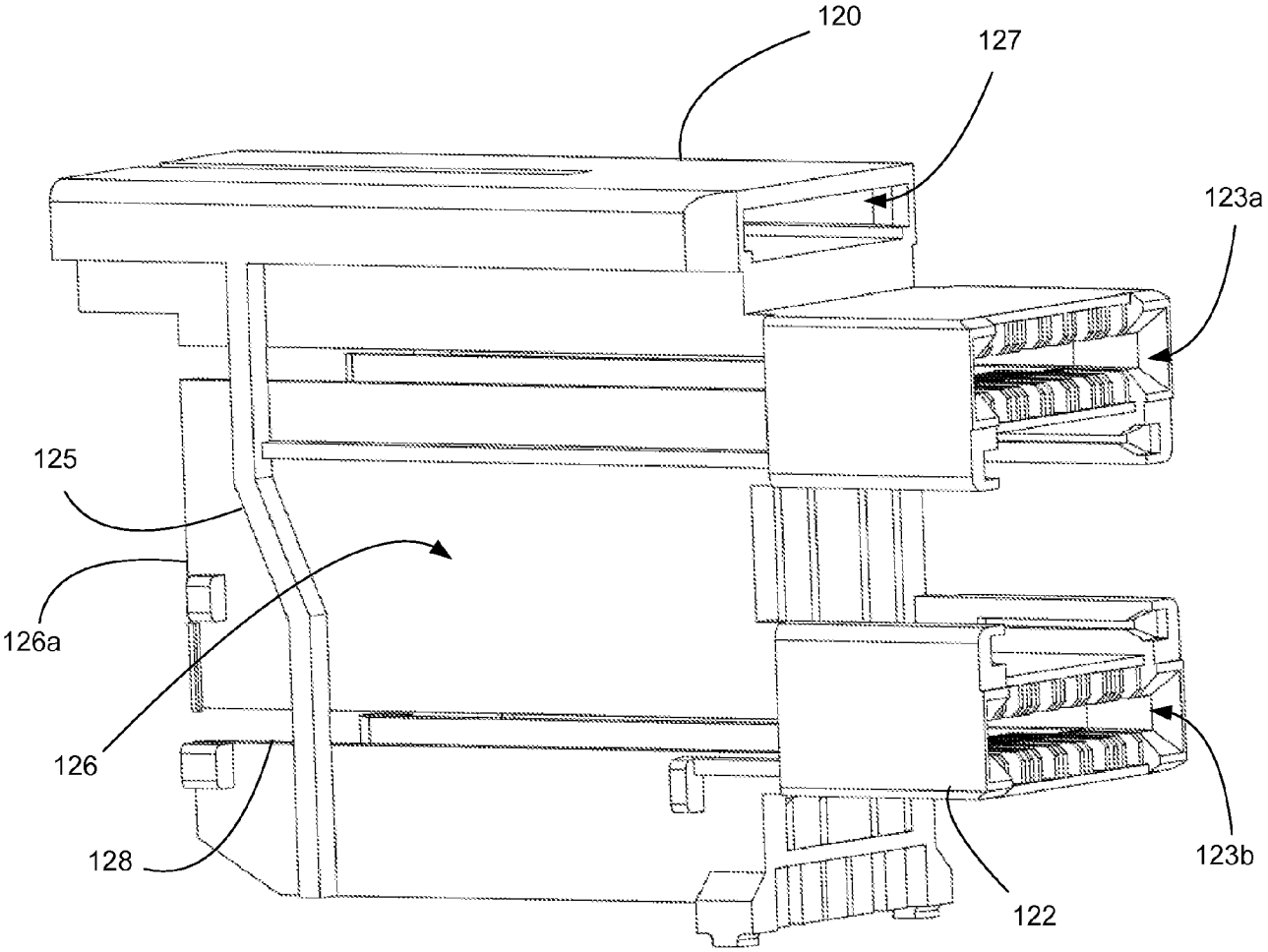
FIG. 20 illustrates a perspective view of an embodiment of a housing suitable for use in a connector system similar to that depicted in FIG. 16.
Figure 21:
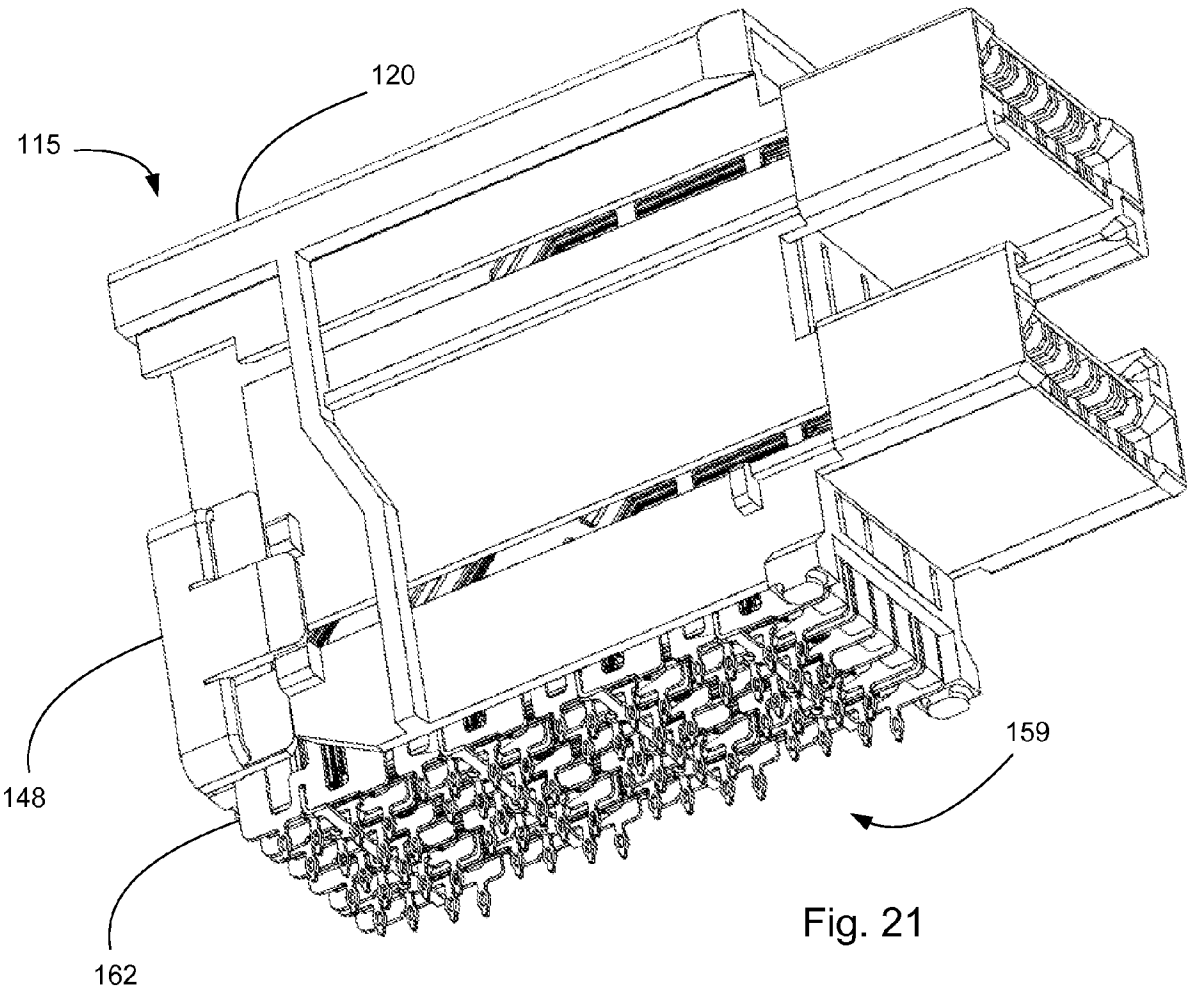
FIG. 21 illustrates a perspective view of an embodiment of a connector.
Figure 22:
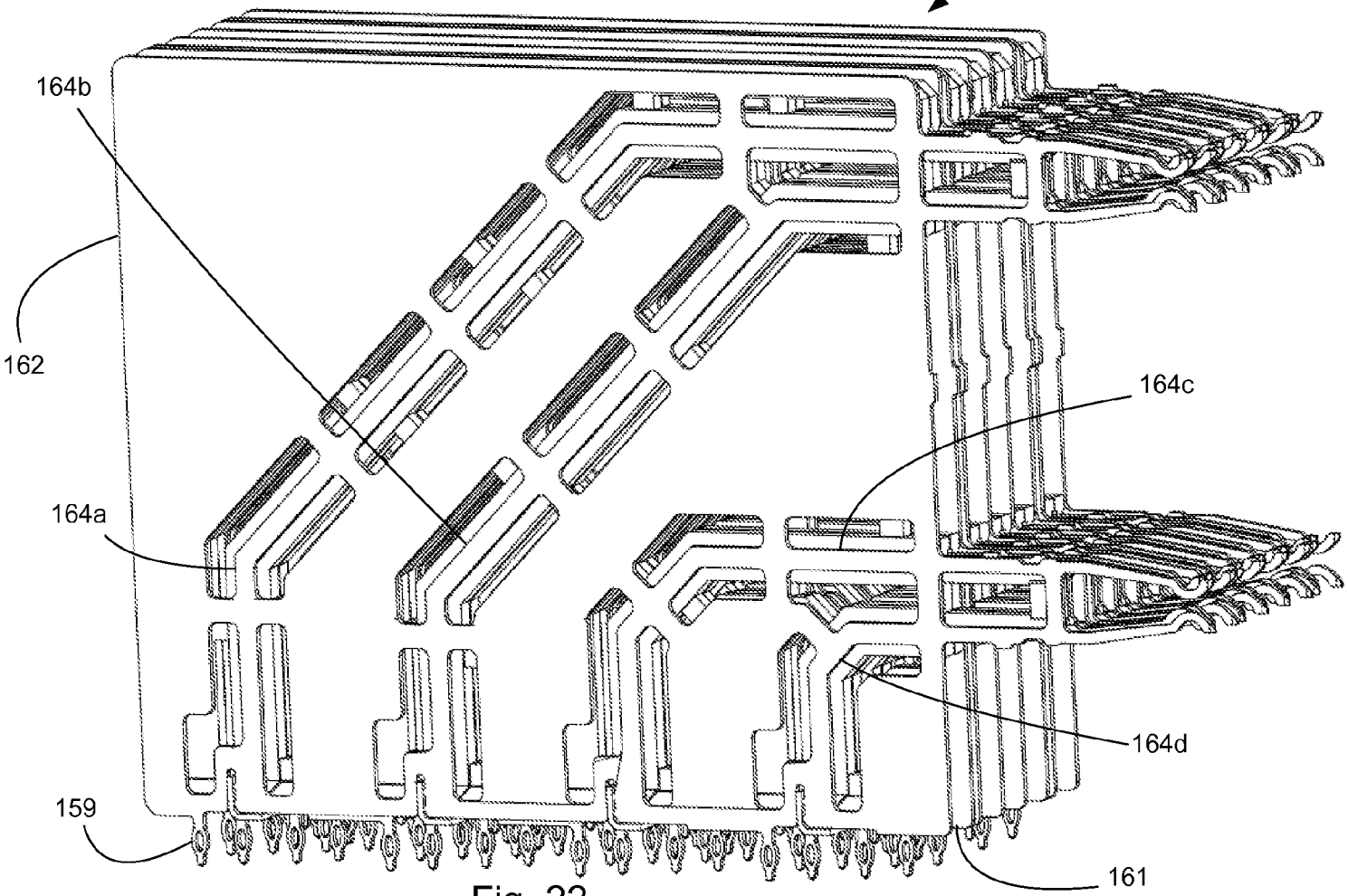
FIG. 22 illustrates a perspective view of an embodiment of a wafer group.
Figure 23A:
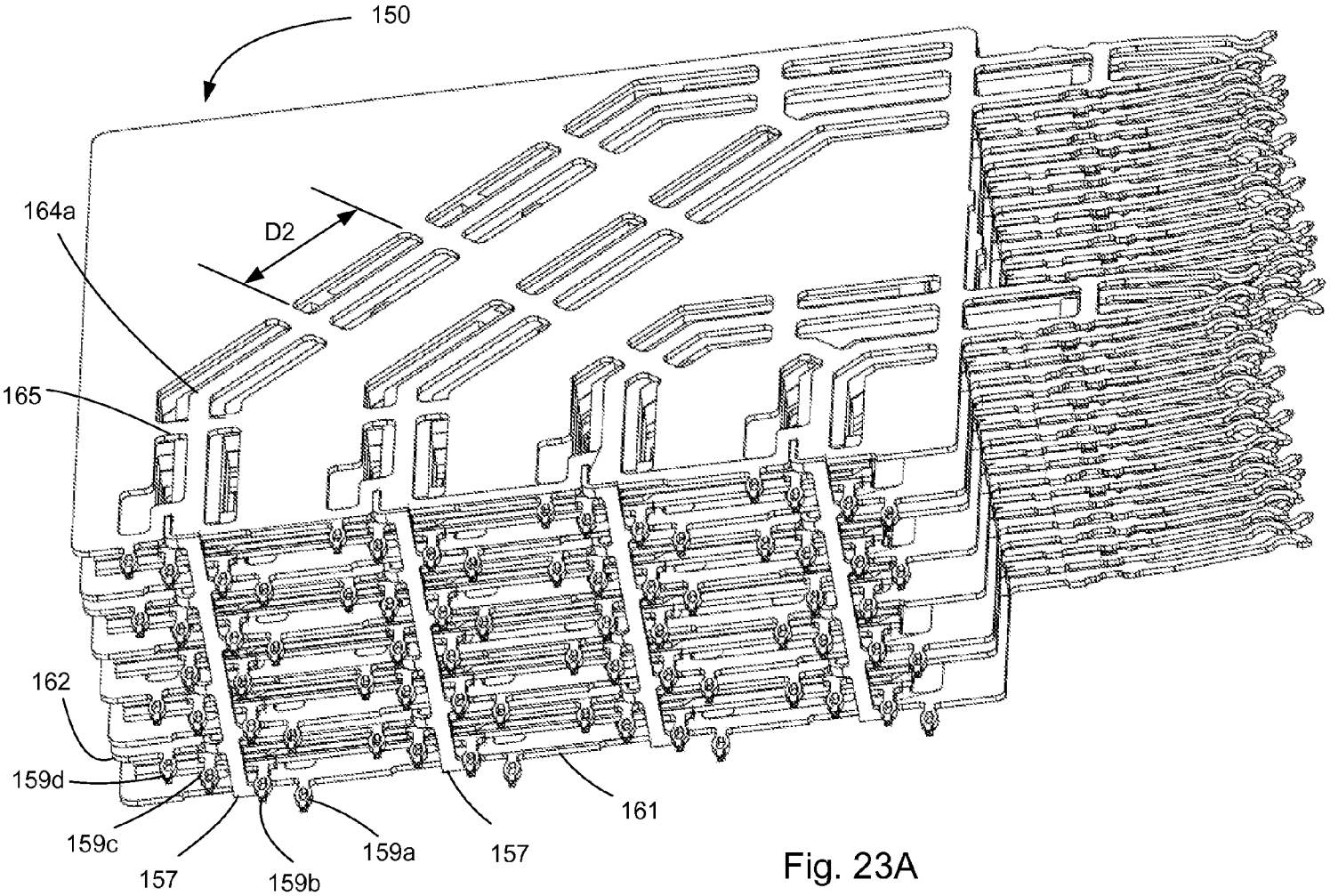
FIG. 23A illustrates another perspective view of the embodiment depicted in FIG. 22.
Figure 23B:
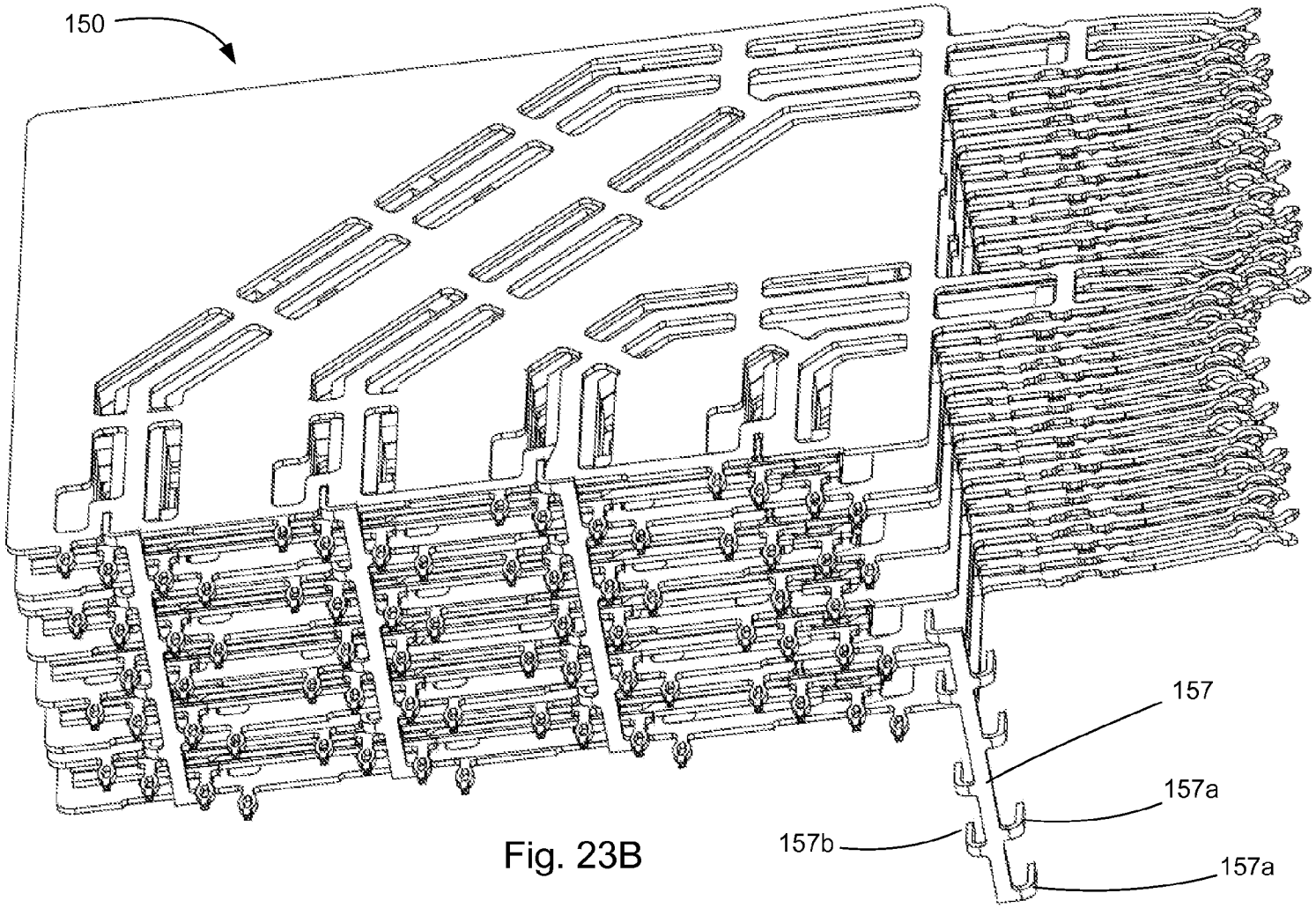
FIG. 23B illustrates a partially exploded perspective view of the embodiment depicted in FIG. 23A.
Figure 24:
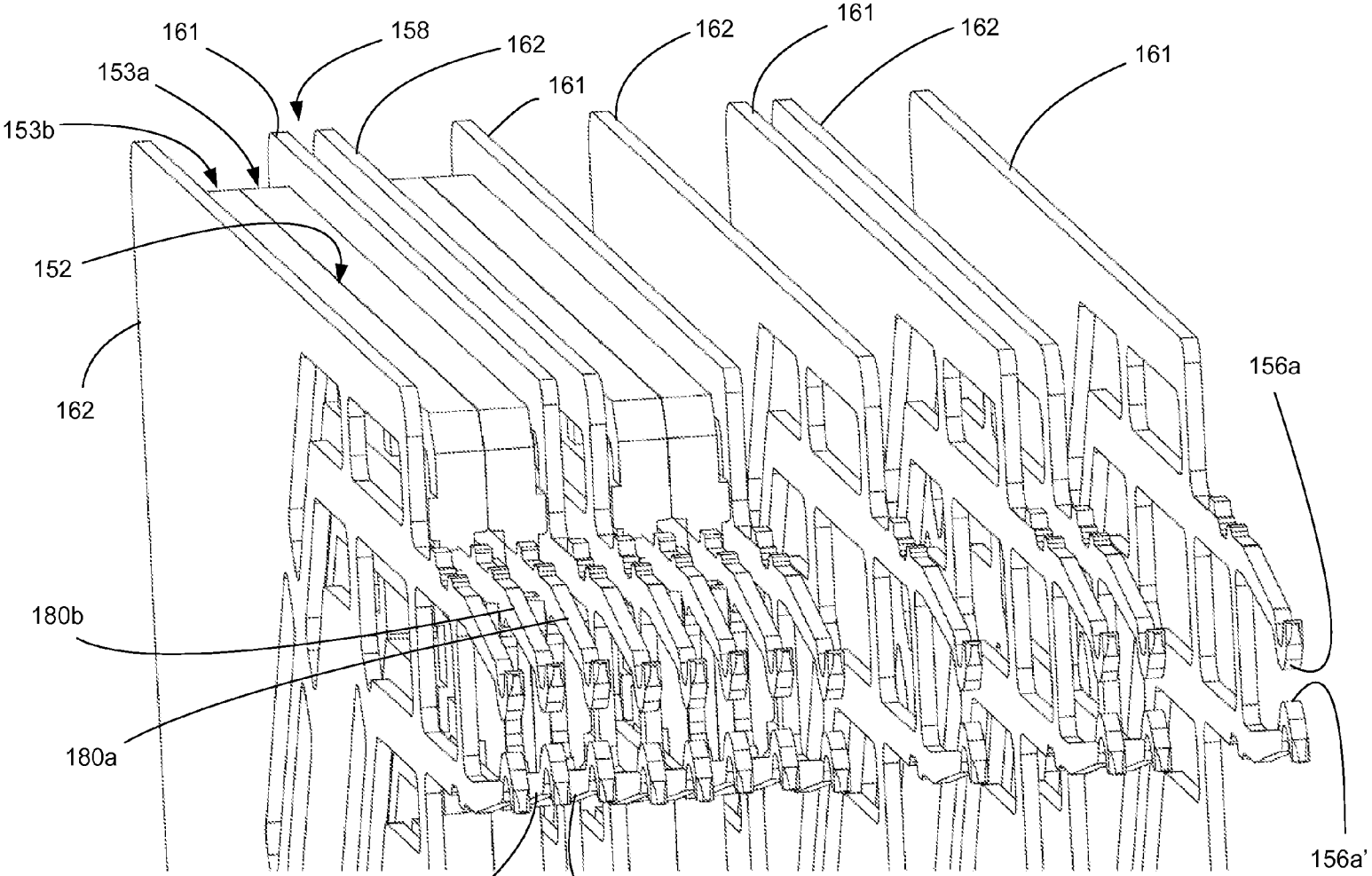
FIG. 24 illustrates a partially simplified perspective view of an embodiment of a wafer group.
Figure 25:
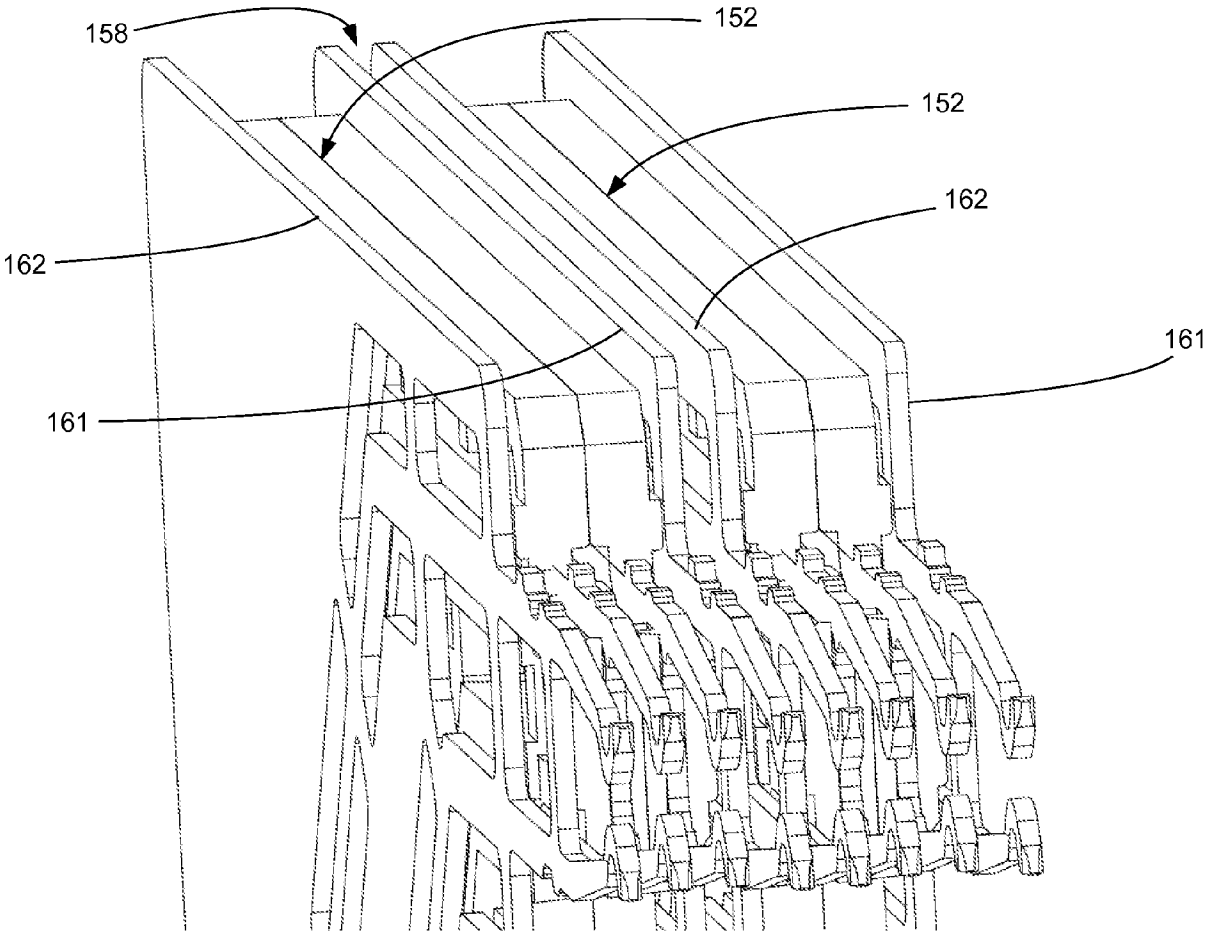
FIG. 25 illustrates a perspective view of portion of a wafer group.
Figure 26:
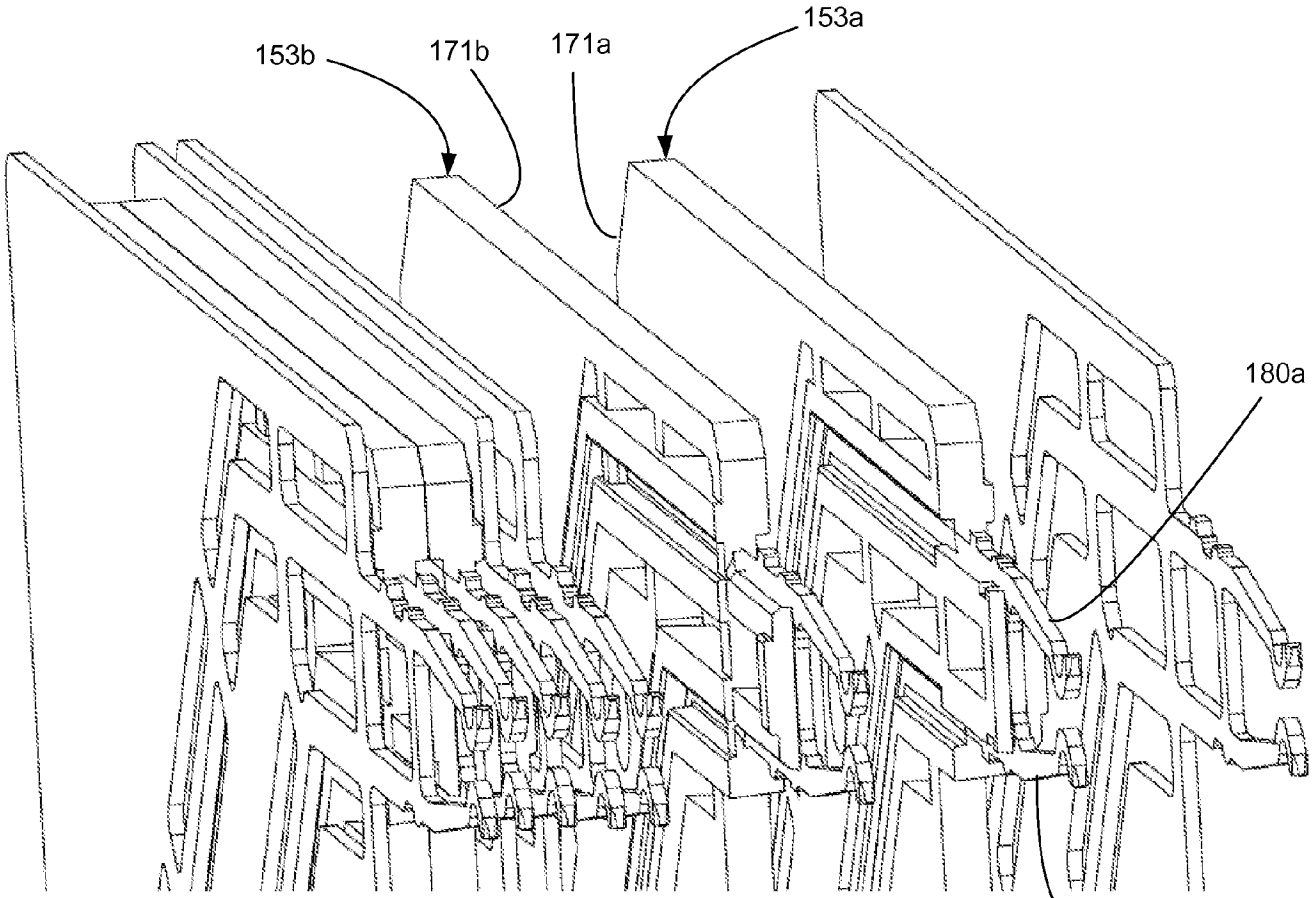
FIG. 26 illustrates a partially exploded perspective view of the embodiment depicted in FIG. 25.
Figure 27:
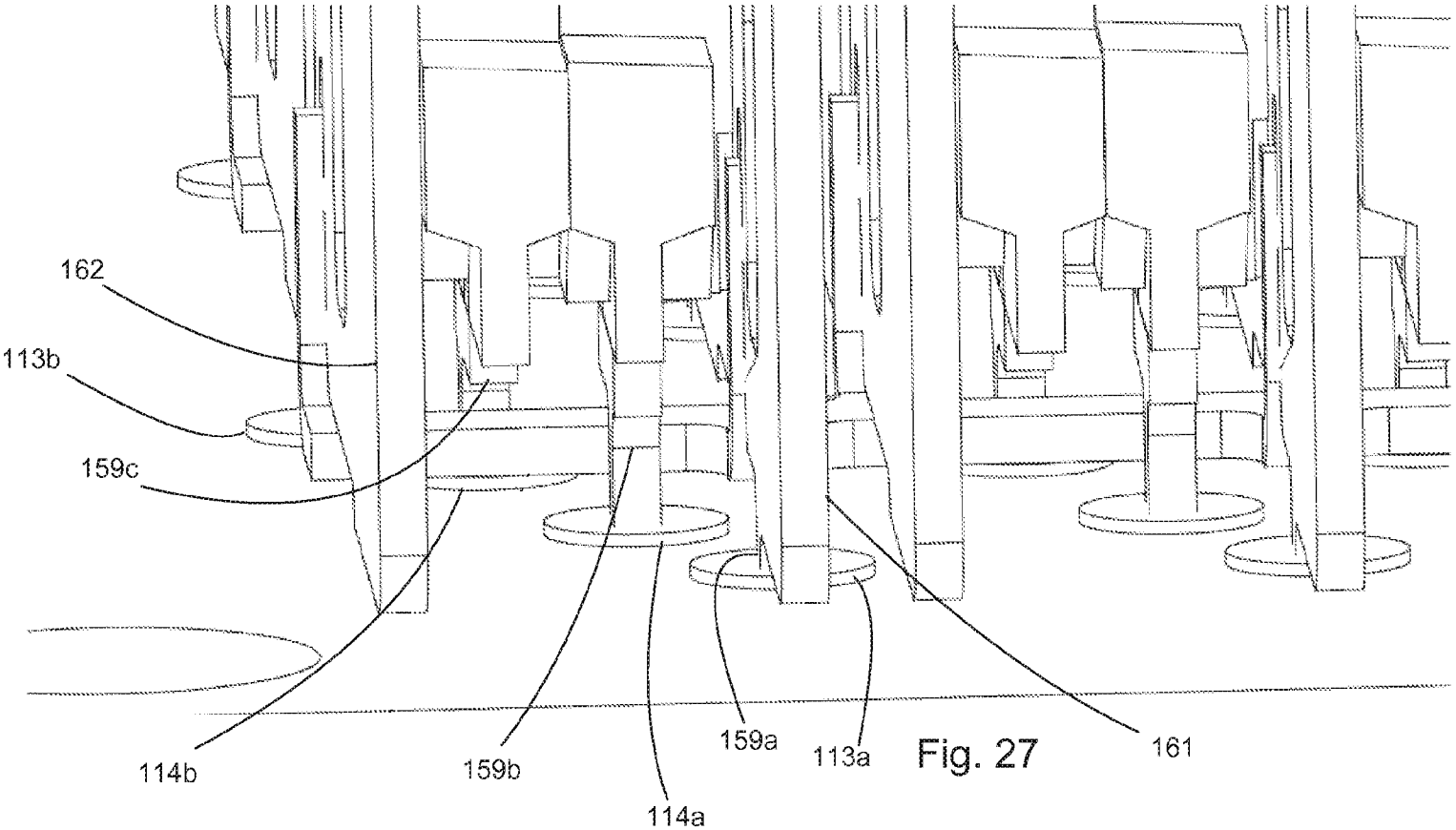
FIG. 27 illustrates a perspective view of an embodiment of a wafer group mounted on a circuit board.
Figure 28:
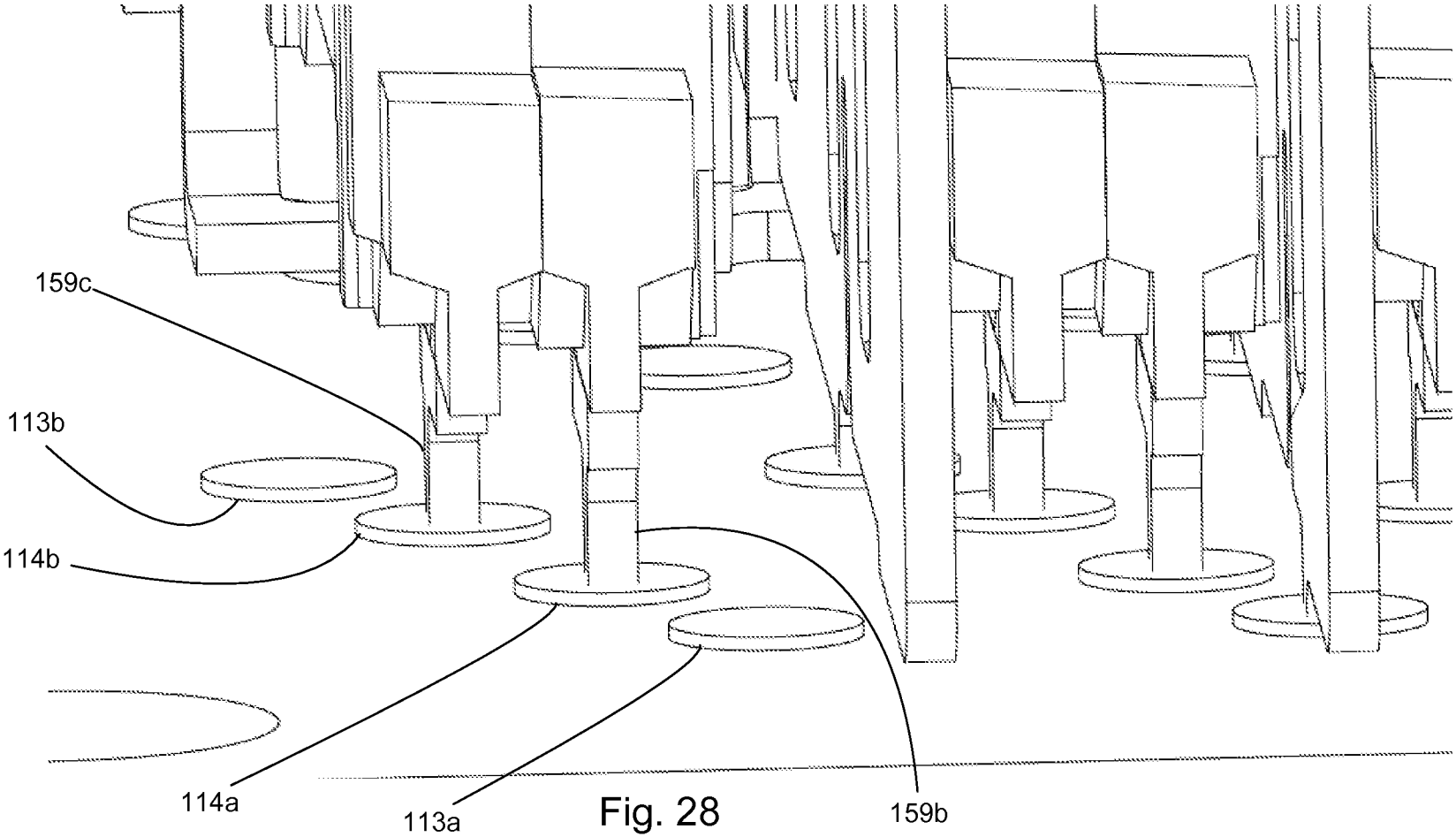
FIG. 28 illustrates a simplified perspective view of the embodiment depicted in FIG. 27.
Figure 29:
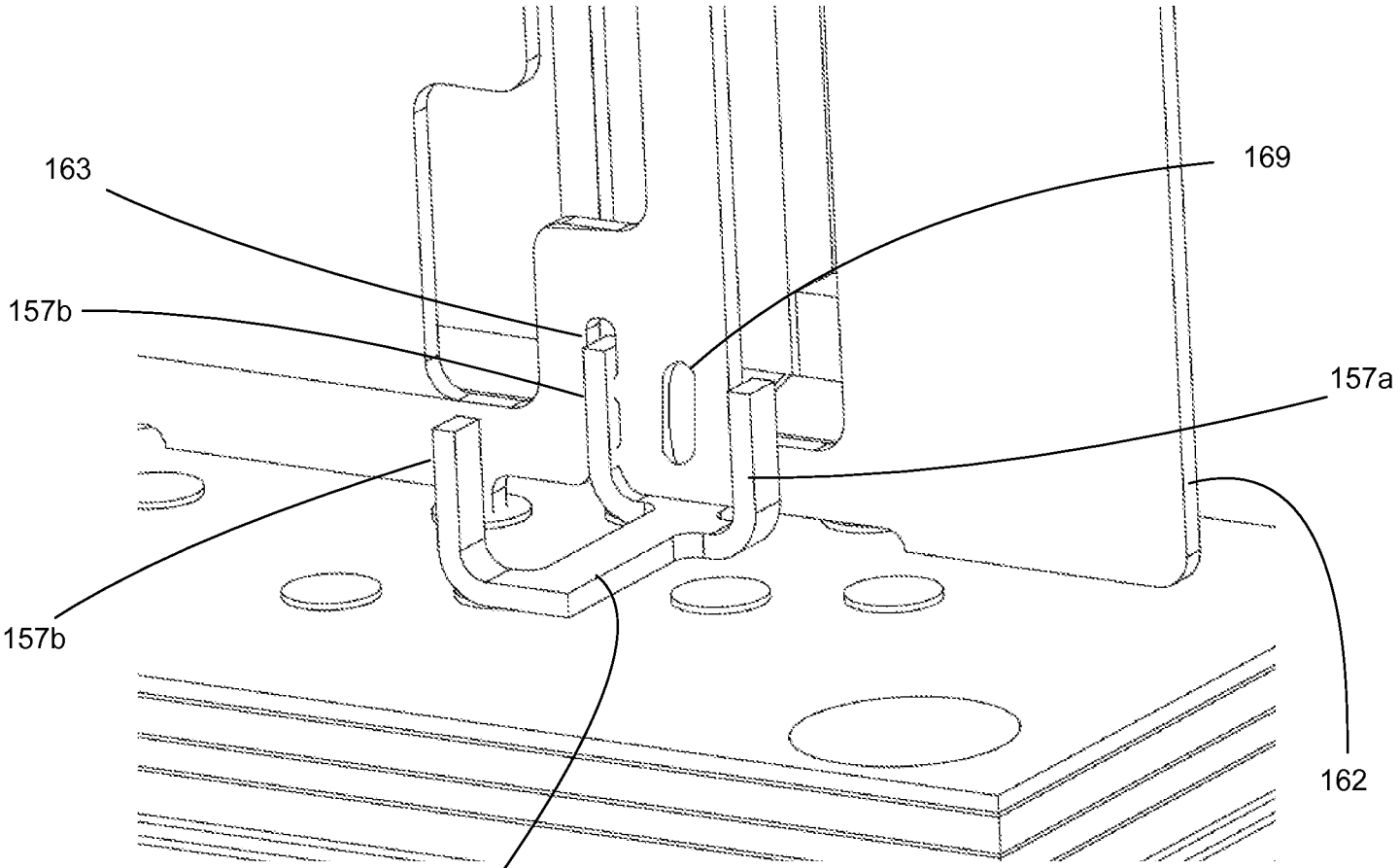
FIG. 29 illustrates a simplified perspective view of an embodiment of a wafer group mounted on a circuit board.
Figure 30:
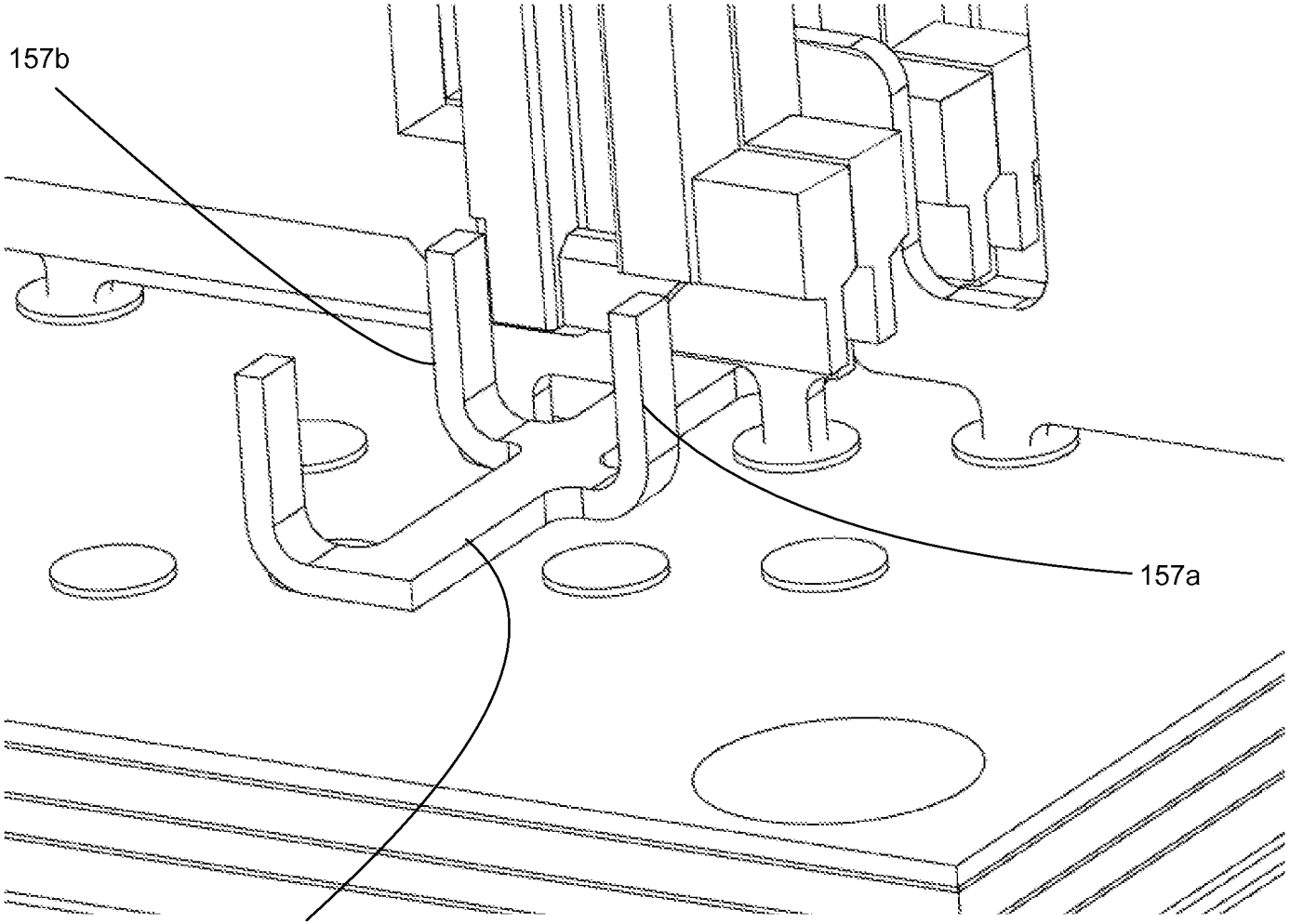
FIG. 30 illustrates a perspective view of the embodiment depicted in FIG. 29 but with additional features included for purposes of illustration.
Figure 31:
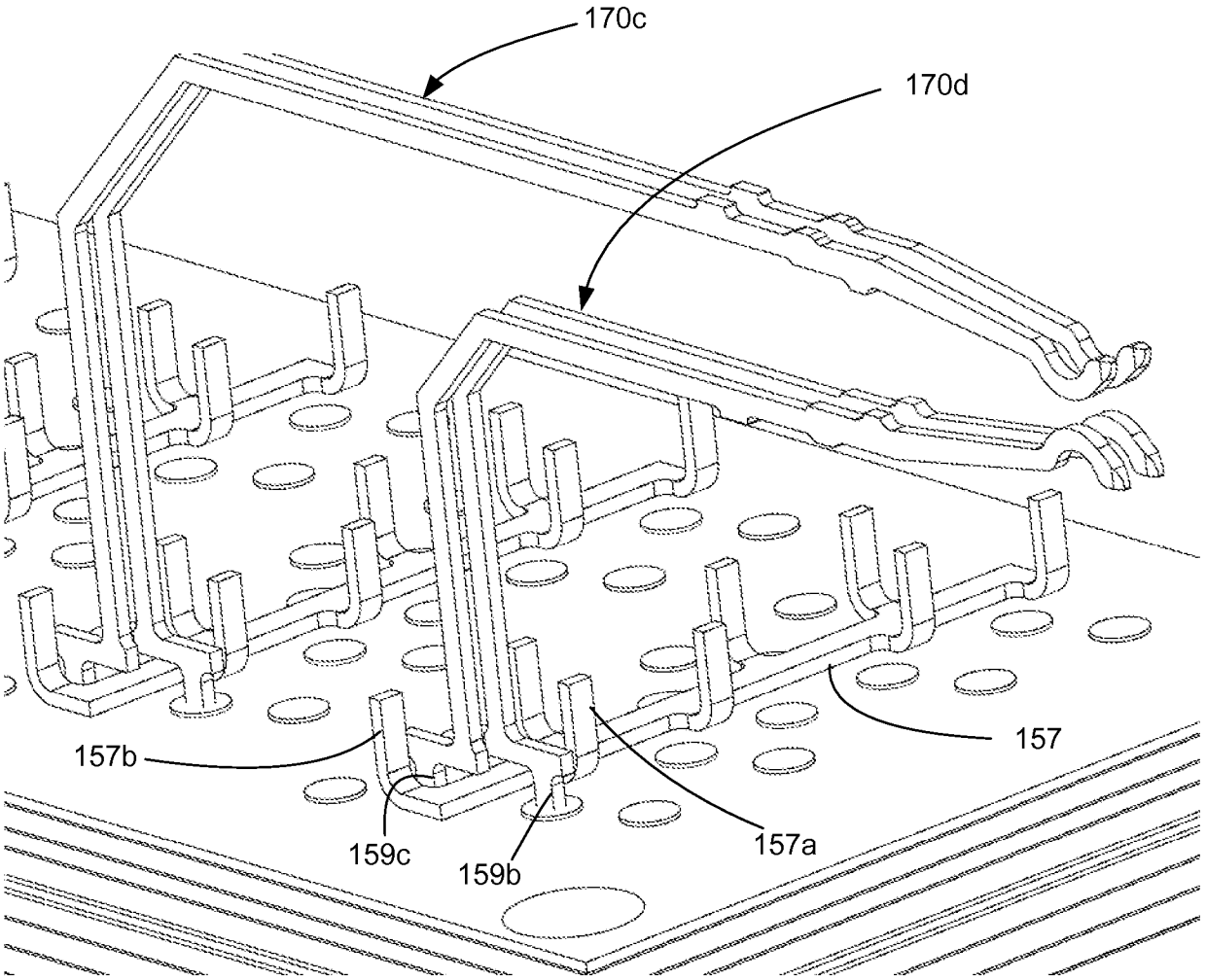
FIG. 31 illustrates a perspective simplified view of an embodiment of a wafer group mounted on a circuit board.
Figure 32A:
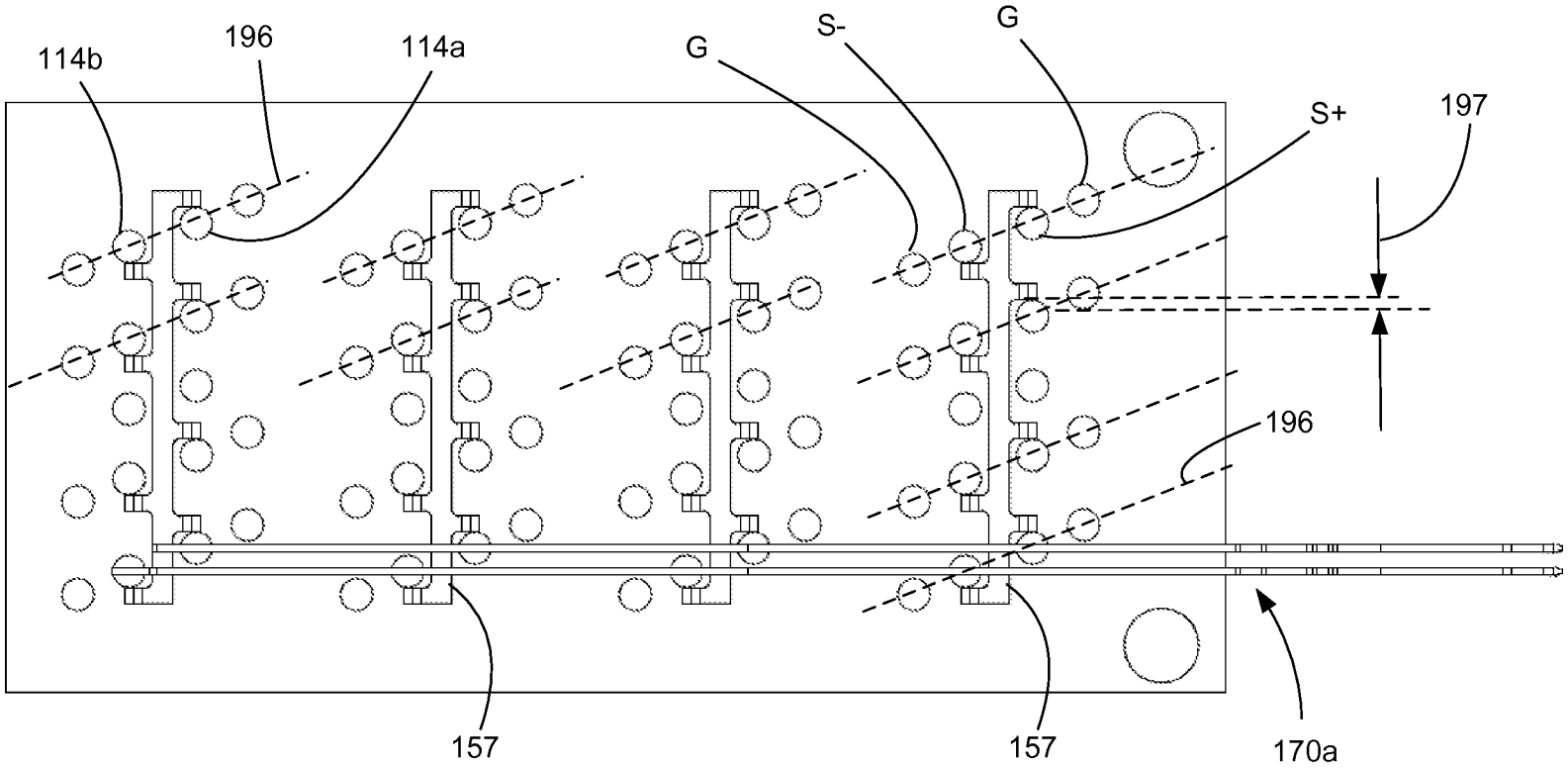
FIG. 32A illustrates a simplified plan view of an embodiment of a wafer group mounted on a circuit board.
Figure 32B:
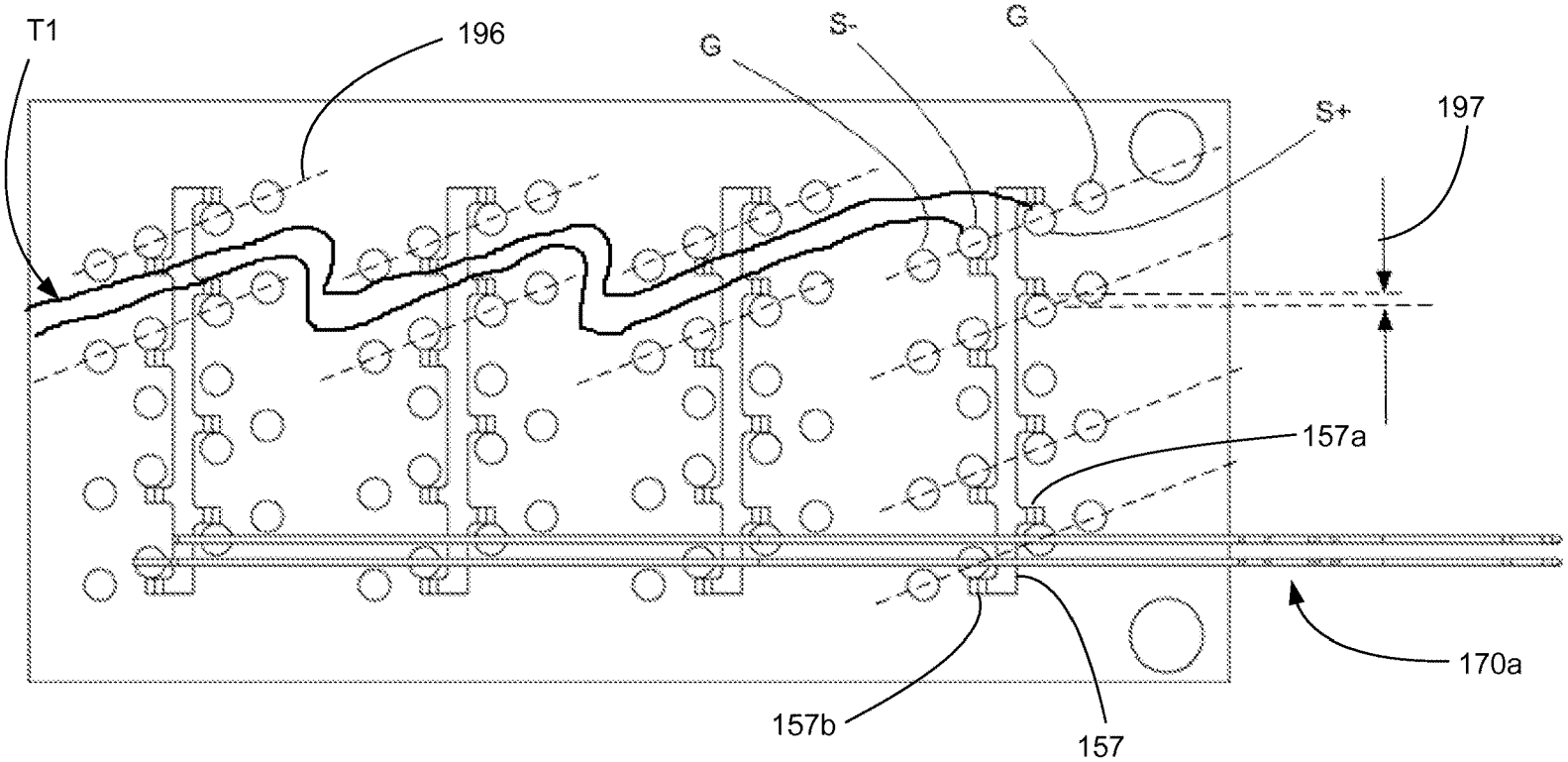
FIG. 32B illustrates a plan view of the embodiment depicted in FIG. 32A with exemplary traces illustrated on a circuit board for purposes of illustration.
Figure 33:
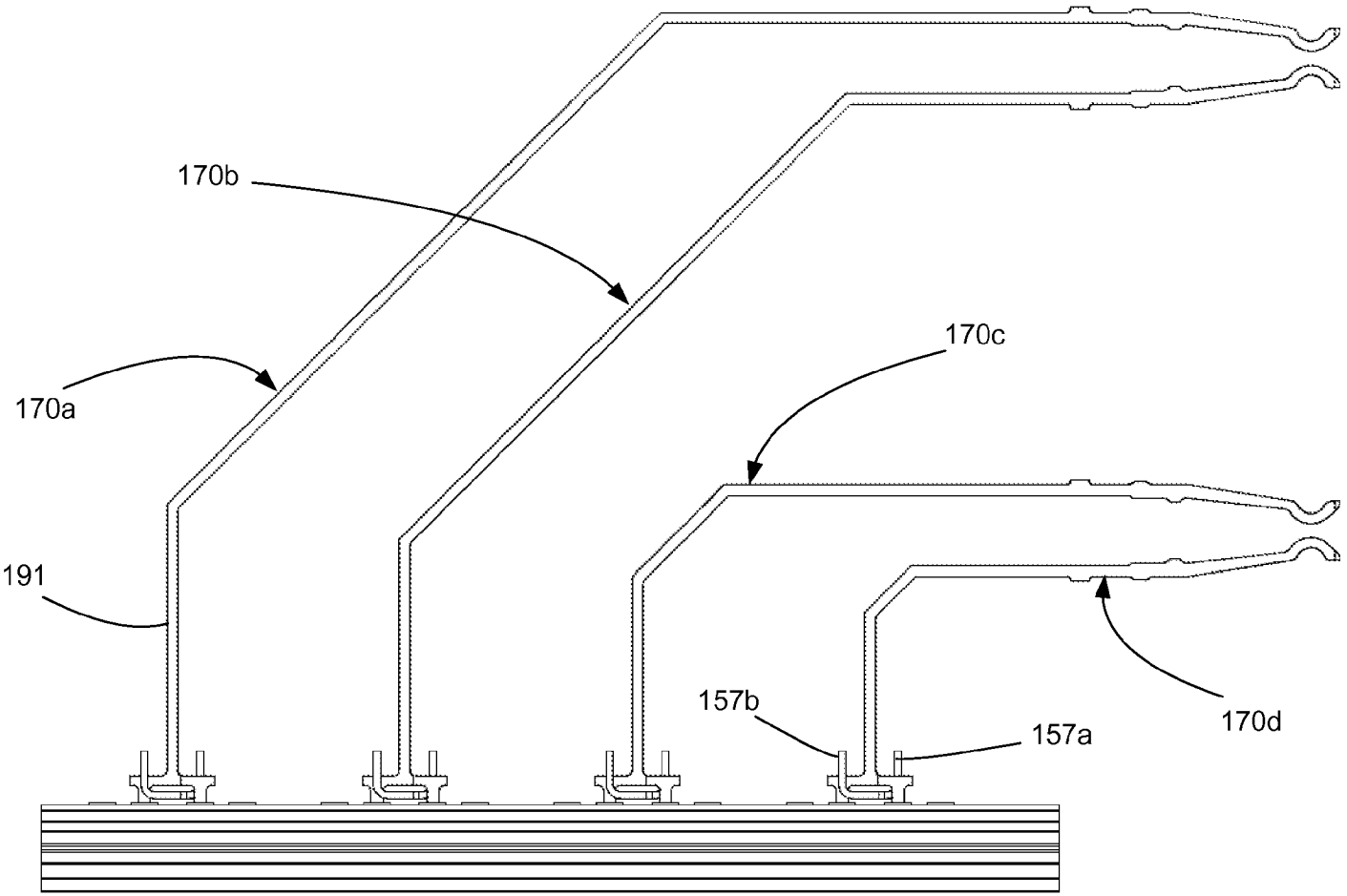
FIG. 33 illustrates an elevated side view of terminals in a wafer set mounted on a circuit board.
Figure 34:
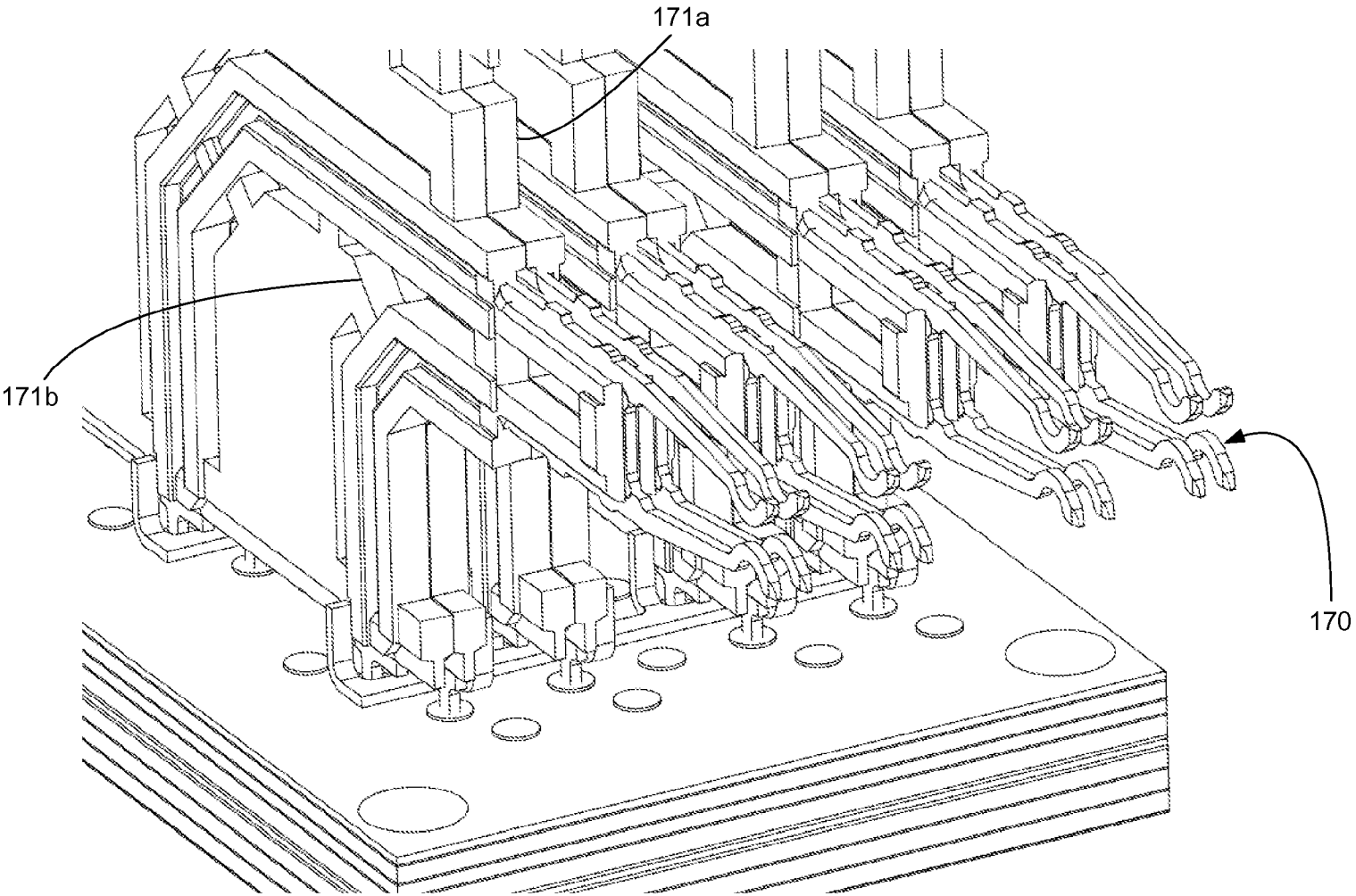
FIG. 34 illustrates a simplified perspective view of an embodiment a wafer group mounted on a circuit board.
Figure 35:
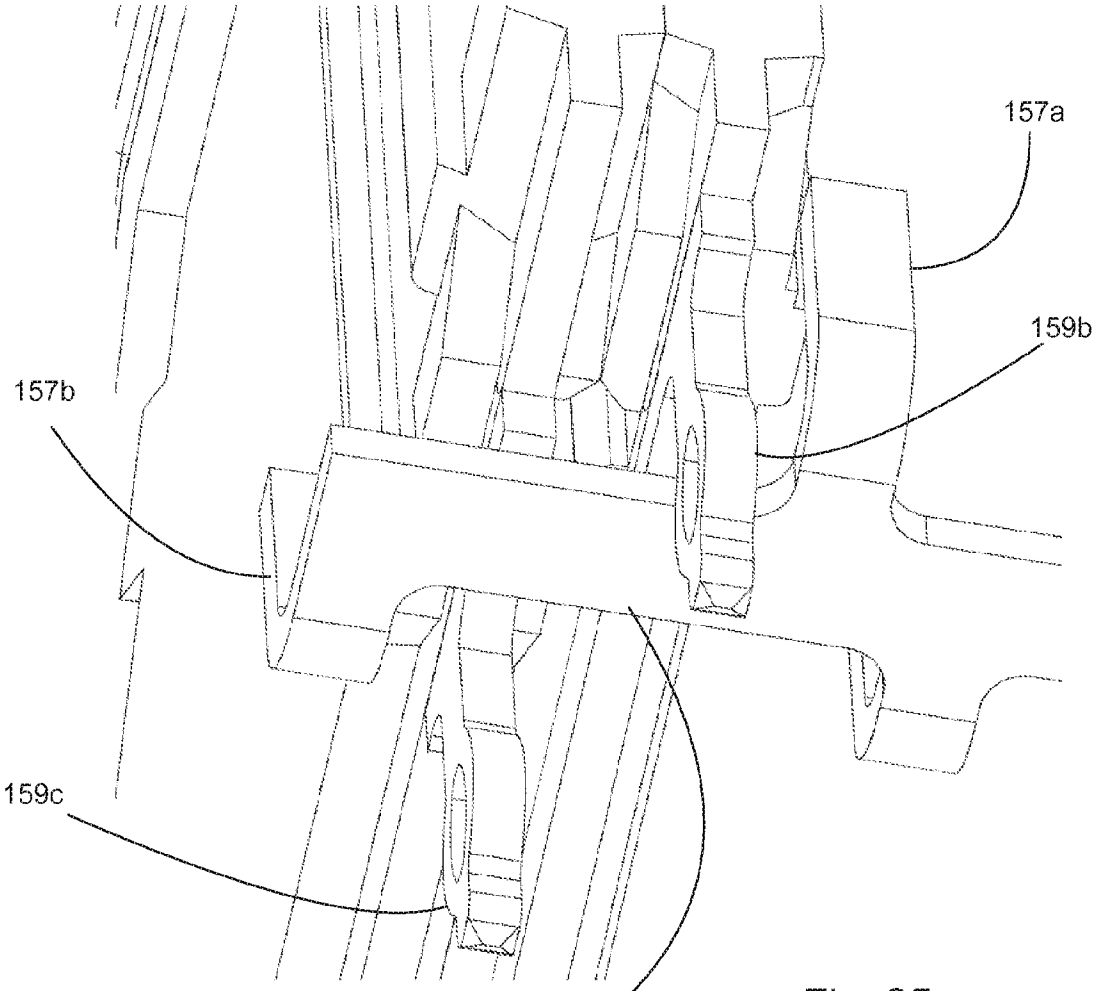
FIG. 35 illustrates a simplified perspective view of an embodiment of a wafer group.
Figure 36:
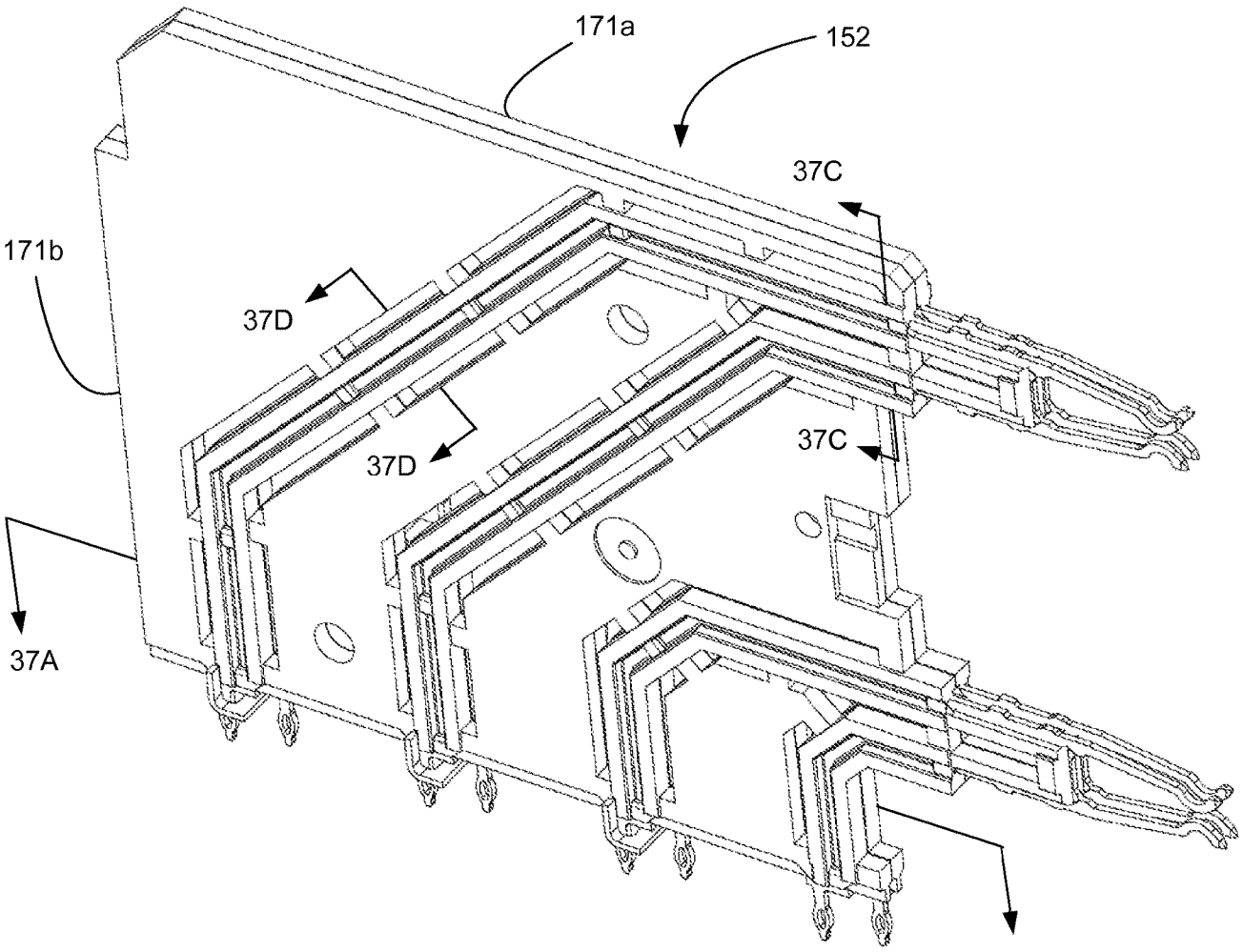
FIG. 36 illustrates a perspective view of an embodiment a wafer set.
Figure 37A:
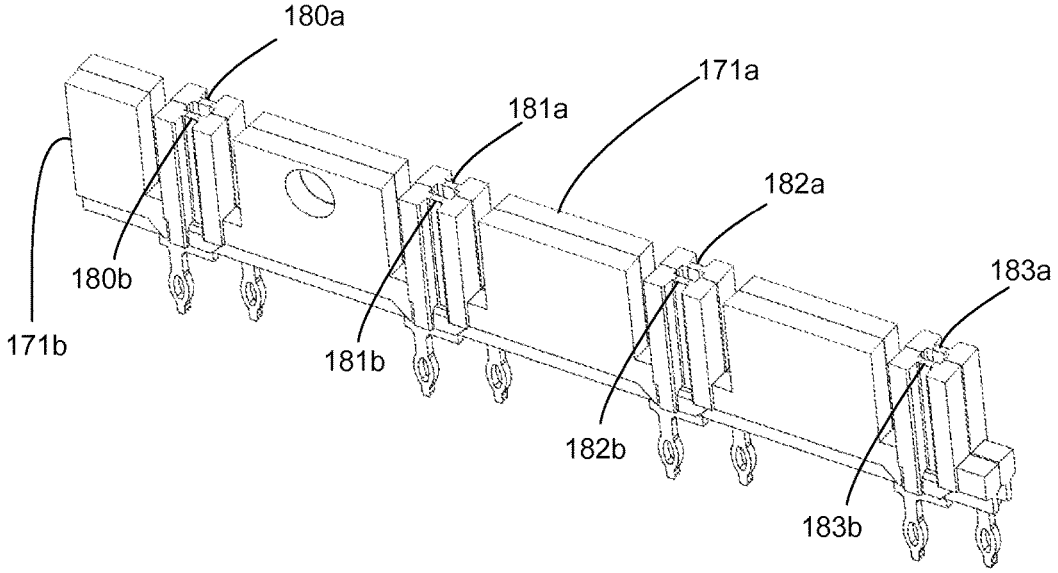
FIG. 37A illustrates a perspective view of a cross-section taken along the line 37A-37A in FIG. 36.
Figure 37B:
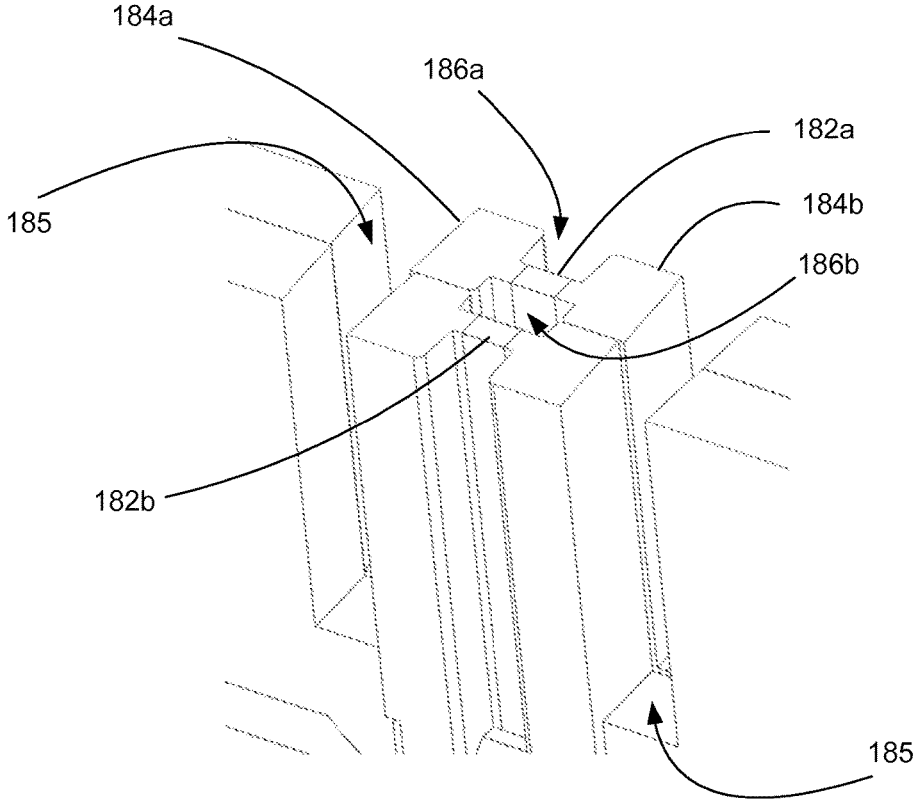
FIG. 37B illustrates an enlarged perspective view of the embodiment depicted in FIG. 37A
Figure 37C:
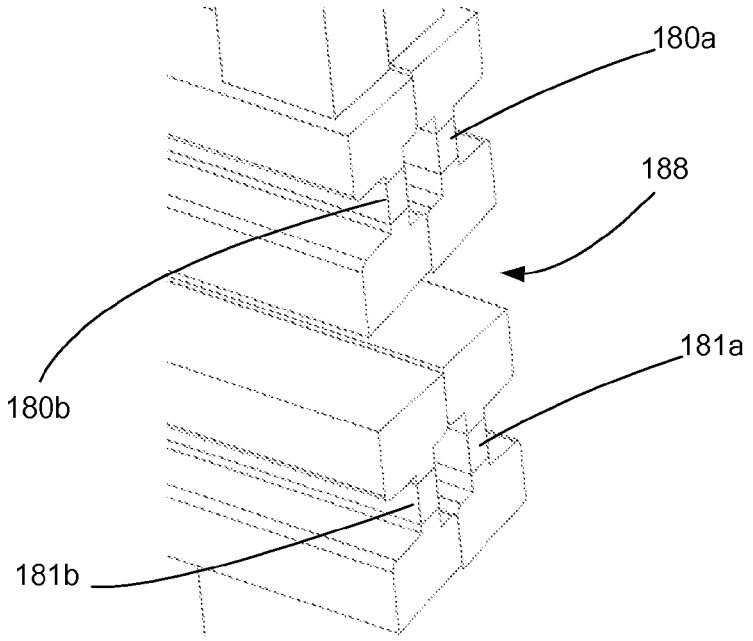
FIG. 37C illustrates a perspective view of a cross-section taken along the line 37C-37C in FIG. 36
Figure 37D:
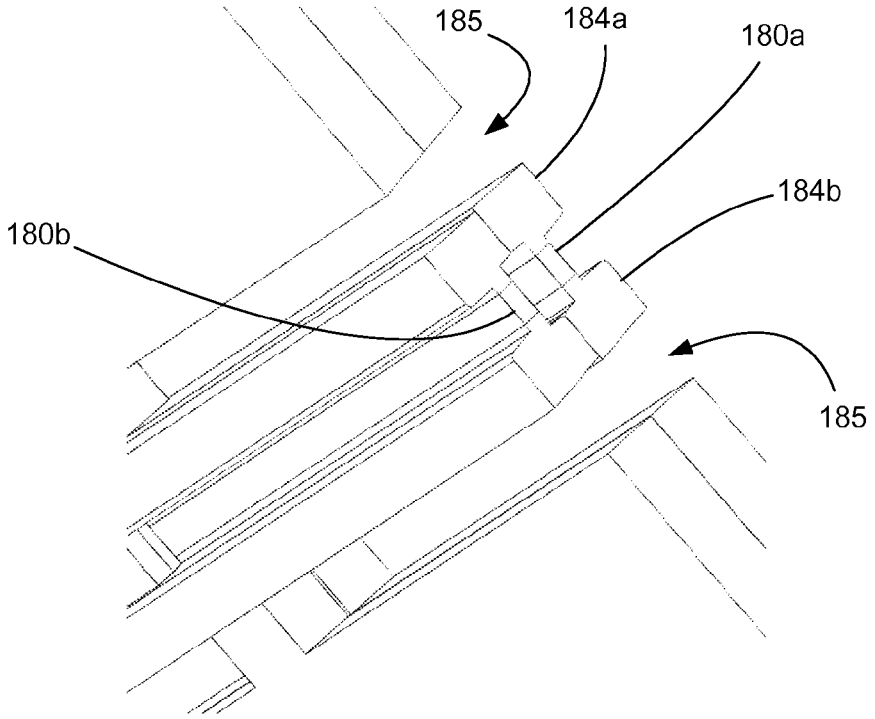
FIG. 37D illustrates a perspective view of a cross-section taken along the line 37D-37D in FIG. 36
Figure 38A:
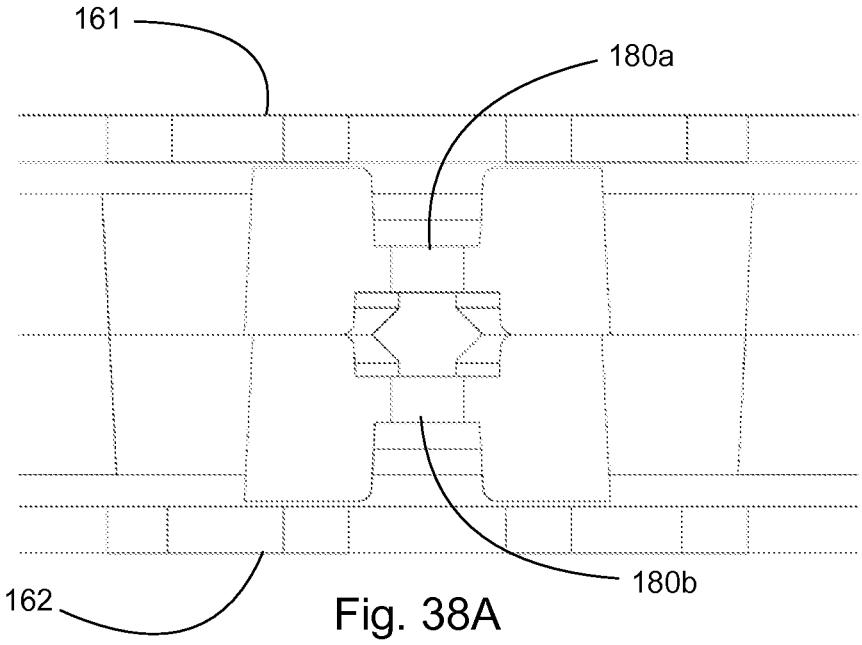
FIG. 38A illustrates an elevated side view of an embodiment of a cross section of a wafer set and corresponding shield plates.
Figure 38B:
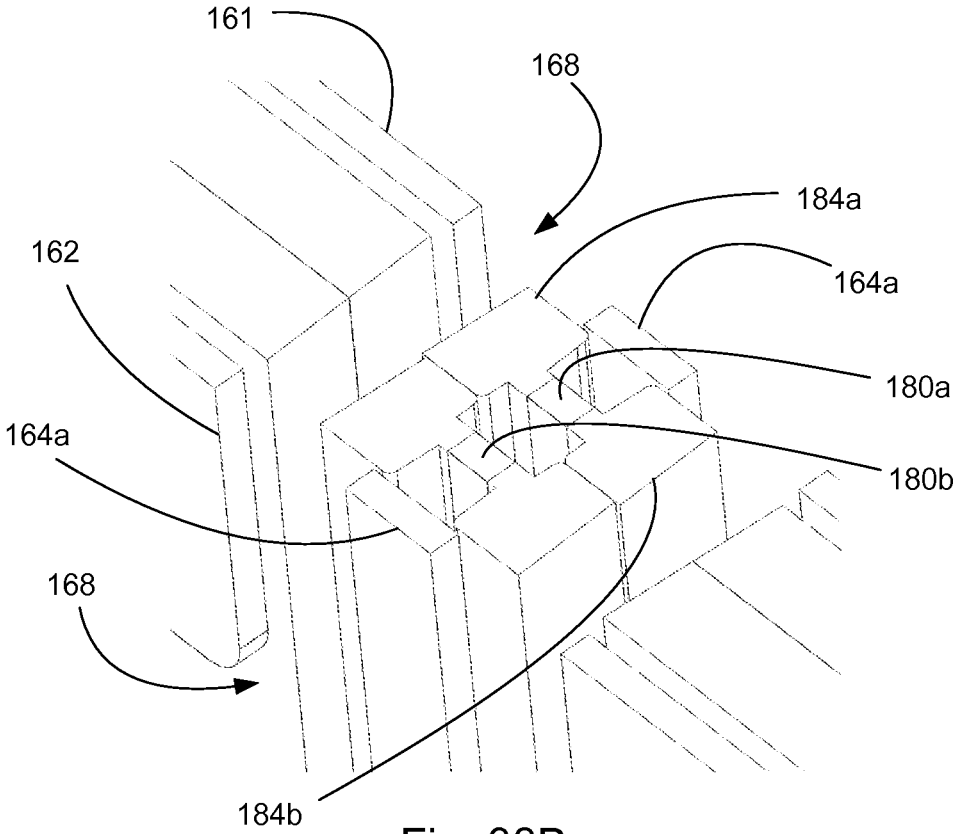
FIG. 38B illustrates a perspective view of the embodiment depicted in FIG. 38A.

FIGS. 16-38B illustrate another embodiment of a stacked connector system 100 with a connector 115 mounted on a circuit board 111. As in the embodiment discussed above with respect to FIGS. 1-15, a connector with a single port (instead of the depicted a stacked configuration) is possible. In addition, a vertically aligned connector could also be provided. However, many of the benefits of the depicted design are best appreciated in a stacked configuration.

The depicted connector 115 provides two card slots 121*a*, 121*b* in surfaces 123*a*, 123*b* of projections 122*a*, 122*b*, respectively. As depicted, each card slot has a flange 129 associated with it. As can he appreciated, the flanges 129 include a slot. Thus, the depicted embodiment provides two aligned "C" shaped ends that are configured to receive a flange from a mating cage.

The connector includes a housing 120 that supports a wafer group 150 and the housing can include a vent channel 127 that allows air to flow from front to back of the connector 115. The housing 120 includes a beam 125 that extends and support a side wall 126 and the beam extends across a channel 128 that extends from a rear edge 126*a* of the side wall 126 to the projections. The channel 128 can allow air to flow past the beam, if desired. Thus, similar to the construction of the housing 20, the depicted two channels are provided in the side wall 126 and the channels are useful to help improve manufacturing of the housing 120 and can provide other benefits as well. An end cap 148 is used in a manner similar to end cap 48 (discussed above).

At least two of the wafers in the wafer group 150 form a wafer set 152 and include terminals that are configured to provide a high data-rate capable channel. A card slot can be configured to provide a differential pair 170 of signal contacts 156*b* positioned between two long ribs 131 while a short rib 132 is positioned between the signal contacts 15*b* that form the differential pair 170. Ground contacts 156*a* can positioned between adjacent long ribs 131. As can be appreciated from FIG. 18B, four differential pairs can be provided on each side of the card slot (such as card slot 121*a* or 121*b*) and the width of the projection 122*a* can be about 12 mm.

As depicted, the ground contacts 156*a* are positioned in a first row 156*c* that defines a line C1 and the signal contacts 156*b* are positioned in a second row 156*d* that defines a line C2. The C1 line is spaced apart from the C2 line by a distance D1 and this has been determined to help improve the performance of the mating interface by allowing for improved impedance control. Specifically, this has been determined to reduce capacitive coupling in the interface and helps provide a more consistent impedance value through the interface (which helps reduces return loss, particularly at high data rates). In that regard, it should be noted that the corresponding contacts on a mating connector can also be staggered if the full benefit of the stagger is desired. The use of the long ribs 121 and short ribs 132 can also help control impedance and help improve this issue.

In the depicted embodiment, the wafer set 152 provides first and second differential pairs 170 on opposite sides of a first card slot 121*a* and further includes another first and second differential pairs on opposite sides of a second card slot 122*a*. Naturally, if only one card slot was provided then only two differential pairs would be provided for each wafer set 152.

As in the embodiment discussed above with respect to FIG. 1-15, surrounding the wafer sets are a first shield plate 161 and a second shield plate 162. The shield plates 161, 162 include tails 159 that are placed in a circuit board and contacts 156 that are positioned in the card slots. Two adjacent shield plates can be separated by a gap 158, which can provide the benefits discussed above with respect to gap 58. Thus, the shield plates 161, 162 and the differential pair provide a G, S, S, G configuration that can repeat. However, while the wafers 153*a*, 153*b* include frames 171*a*, 171*b* formed of an insulative material that supports separate terminals, the shield plates 161, 162 omits the plastic frame and the individual terminals and instead is depicted as a unitary structure that obviates the need for a plastic frame.

Unlike the shield plates 61, the shield plates 161, 162 include ground terminal bodies 164*a*-164*d* that extend along and are aligned with bodies of the terminals provided in the wafers 153*a*, 153*b*. The terminal bodies 164*a*-164*d* are coupled to the rest of the shield plate with webs and it has been determined that such a constructions helps provide better signal performance, as will be discussed more below.

In the depicted embodiment, the connector is providing what is commonly known as a 4X configuration, with four differential channels configured to transmit and four differential channels configured to receive. This is done by providing four high data-rate capable channels on both sides of the card slot. The embodiments depicted in FIGS. 1-15 are configured to provide a connector with a 0.5 mm pitch interface while still supporting 10 Gbps on each differential channel. The embodiments depicted in FIGS. 16-38B are configured to provide a 0.5 mm pitch interface while still supporting 20 Gbps on each differential channel. Because of the tight spacing it has been determined that improved performance can be provided by having a ground plate on both sides of a differential channel. When two differential channels are arranged side by side the terminal pattern at the mating interface is G, S, S, G, G, S, S, G. Thus, along the width of the corresponding card slot each differential pair has its own associated pair of ground plates.

As in the embodiments discussed above with respect to FIGS. 1-15, typically is desirable to have the impedance of the terminals that form the signal pair to be relatively constant so as to avoid reflections that can be caused by impedance discontinuities. To improve the interface with the supporting circuit board, a common bar 157 extends between and is electrically connected to the shield plates 161, 162 with fingers 157*a*, 157*b*. The benefits of using a commoning member are generally known. While the embodiment depicted in FIGS. 1-15 had a commoning member between different pairs of signal terminals, the embodiment depicted in FIGS. 16-38B can include a common bar that extends between two signal terminals 159*c*, 159*d* that make up a differential pair 170. It was discovered, somewhat surprisingly, that providing the common bar 157 between the signal tails that form the differential pair 170 improved the impedance of the differential pair 170 at the mounting interface while reducing cross talk.

The fingers 157*a*, 157*b* are configured to engage the shield plates 161, 162 by being positioned in grooves 163. To provide a balanced and desirable termination between the connector 115 and the circuit board 111, the fingers 157*a* can be provided on opposite sides of the common bar 157 and one finger can he aligned with the signal tail that is positioned on a first side of the common bar 157 while the other finger is aligned with signal tail positioned on a second side of the common bar 157. In other words, the fingers 157*a*, 157*b* can shadow the signal terminal tails. Thus, in an embodiment the fingers 157*a*, 157*b* that engage the shield plates 161, 162 on opposite sides of the terminals that form the differential pair 170 can be configured so that both fingers 157*a*, 157*b* extend in opposite directions from the common bar 157. In addition, the fingers 157*a*, 157*b* can be configured so that they extend upward away from the circuit board 111 while the common bar 157 extends parallel to the circuit board 111. Because the common bar 157 extends between the tails of the terminals that form the differential pairs 170*a*-170*d*, just four common bars 157 are used. It should be noted that the terminals that form the differential pairs depicted herein each have a contact (such as contact 156), a tail (such as tail 159) and a body portion (such as body portion 191) extending therebetween.

Because of the small pitch (preferably the pitch can be 0.5 mm although features depicted could also be used in connectors with larger pitch), the vias need to be offset. It has been determined that arranging the signal vias 114*a*, 114*b* in line with the associated ground vias 113*a*, 113*b* so as to provide a number of angled rows 196 provides a number of benefits.

The footprint of the connector 115 is designed to provide good performance and one feature that helps improve the performance is having each pair of terminals that form a differential pair positioned in the row 196 that has a ground vias on both sides of the signal vias. The use of the ground vias helps provide shielding for the signal vias by tending to block a portion of any coupling that might otherwise take place between pairs of signal terminals. As can be appreciated from FIG. 32A, the rows 196 need not be perfectly aligned as substantial benefits can be realized so long as an imaginary line intersects each of the four vias in the row 196. In other words, the amount of overlap between the imaginary line and the row 196 can vary from via to via within the row 196.

One substantial benefit of the design depicted in FIGS. 16-38B is that the design allows back routing (unlike the design depicted in FIGS. 1-15, where back routing is not feasible). While straight-back routing would be even more desirable, even the ability to have back routing is quite useful. For example, as can be appreciated from FIG. 32A-32B, the traces (such as trace pair T1—which is drawn for illustrative purposes, it being understood that the trace will likely be internal to the circuit board and will have a more consistent space in practice) can stay within the perimeter of the connector (as defined by the outer most tails) while routing back. Naturally, four layers would be used to route back the depicted stacked connector as it has four rows of differential signals with four differential pair in each row but the ability to avoid routing along the side of the connector substantially reduces the needed board space on the side of the connector and makes it possible to increase the port density on a circuit board. Thus, the ability to have back routing makes the depicted connector suitable/capable of meeting requirements that other connectors simply cannot meet.

As can be appreciated, the shield plates 161, 162 omit a frame and thus the shield plates 161, 162 themselves provides the structural support that ensures they maintains their position relative to the adjacent wafer or shield plate. To improve the launch from a supporting circuit board, an optional aperture 169 can be provided in the shield plate adjacent the signal terminals (see FIG. 29) so as to reduce the capacitive coupling. Another feature that can be used to improve the impedance (e.g., to reduce any dip or spike in the impedance) is to have the fingers of the commoning member engage the shield plate in an area aligned with the signal terminal tails, as discussed above.

Wafer 171*a*, 171*b* can both have similar construction, although it may be desirable to have them designed so as to be symmetrical about a centerline. FIGS. 37-37D and 38A-38B illustrate views of wafer set 152 and show crosssections with and without the shield plate 161, 162. Wafer 171*a* supports terminals 180*a*, 181*a*, 182*a* and 183*a* while wafer 171*b* supports terminals 180*b*, 181*b*, 182*b* and 183*b*. Terminals 180*a*, 180*b* form a first differential pair, terminals 181*a*, 181*b* form a second differential pair, terminals 182*a*, 182*b* form a third differential pair and terminals 183*a*, 183*b* form a forth differential pair. Each terminal is supported by insulative beams 184*a*, 184*b* that are provided on both edges of the terminal To provide for desirable performance, air is provided on both sides of the terminals by providing openings 186*a*, 186*b* in the insulative members on both sides of the terminals. Depending on the length, thickness and width of the terminals it may be necessary to adjust the size of the openings 186*a*, 186*b*. It should be noted that while the terminals (whether they are ground terminals or signal terminals) are on a constant pitch. Because the shield plates 161, 162 do not include an insulative frame it is possible to adjust the amount of insulative material that forms the frame that is on each side of the terminals and this adjustment, along with adjustments in the opening size, can be used to help improve performance of the differential pair. To help provide improved cross talk performance, insulative slots 185 extend along the body of the terminals and help provide a tuned channel in the connector body. To further improve cross-talk performance a larger slot 188, which has a first gap between the housing that can be at least 20% larger than a second gap between the housing that is associated with the slot 185.

As can be appreciated, the shield plates 161, 162 supports ground terminal body (164*a*-164*d*) that are aligned with the bodies of the signal terminals (the signal terminals such as terminals 180*a*, 180*b* being configured to be broad-side coupled together) and the ground terminal body is joined periodically to the base shield plate with a grounding web 165 (thus there is an elongated slot 168 in the shield plates that follows the ground terminal body and is intersected by ground web 165). Thus, the grounding web 165 acts as a commoning member within the shield plates 161, 162. While it typically is beneficial to have shorter distances between commoning members, it has been somewhat surprisingly determined that it is beneficial in the depicted design to have the grounding webs separated by a distance D2 that is greater than 3.0 mm and more preferably at least 3.5 mm (at least in the main body of the shield plate). It should be noted that, depending on the thickness of the shield plate, it may be undesirable to have D2 become too large because then the shield plate may be deficient from a structural standpoint. A person of skill in the art, however, can easily determine the desired maximum distance C1 can be depending on the material and physical properties of the shield plate and the desired structural properties. It has also been determined that improved performance is obtained when the grounding web is between 0.4 and 0.7 mm wide.

As noted above, the wafers 153*a*, 153*b* are configured so that there is an opening 186*a*, 186*b* on both sides of the terminals (both between the signal pairs and between the shield plates). To provide desirable tuning, the terminals can be insert molded so that the frames 171*a*, 171*b* that supports the terminals are minimized along the terminal path between the contact and the tail. This is helpful, in part, because the terminals are expected to be formed of thin stock—in the range of 0.007 in (7 mil stock or about 0.18 mm thick)—and thus the additional air reduces the dielectric constant and helps provide the desired impedance. As depicted, the signal terminals are offset in the corresponding frame (even though the terminals and the shield plates are a consistent pitch—which can be 0.5 mm) so that the air channel in the frame between the shield plates (which act as a ground terminals) and the signal terminal is deeper than a signal channel formed between the differential pair. However, when the system is reviewed, as can be appreciated from FIGS. 38A and 38B, the size of the resultant air channel between the two signal terminals is larger than the resultant air channel between a signal terminal and a shield plate. While this would normally decrease the amount of coupling between the signal terminals and tend to promote more neutral instead of preferential coupling, the overall structure (and the absence of a plastic frame around the shield plate) helps compensate for the spacing and thus the system is still preferentially coupled (e.g., more of the energy is carried by the mode associated with differential coupled terminals than between the signal terminals and the ground terminal). As can be appreciated, therefore, the depicted configuration can allow the signal terminals to be preferentially coupled together.

The disclosure provided herein describes features in terms of preferred and exemplary embodiments thereof. Numerous other embodiments, modifications and variations within the scope and spirit of the appended claims occur to persons of ordinary skill in the art from a review of this disclosure.

I claim:

1. A connector, comprising:

a housing supporting a card slot with a first side and a second side;

a wafer set supported by the housing, each wafer set including a first wafer and a second wafer that are adjacent, each wafer supporting a first terminal and a second terminal, each of the terminals having a contact, a tail and a body portion extending therebetween, the tails having a press-fit configuration, wherein the contacts of the first terminals are positioned on the first side and the contacts of the second terminals are positioned on the second side, wherein the first terminals form a first differential pair and the second terminals form a second differential pair, the bodies of the terminals that form the differential pairs extending in substantial alignment from the contacts to the tails;

a first shield plate and a second shield plate positioned on opposing sides of the wafer set, the first and second shield plates providing ground tails and ground contacts, the ground contacts configured to be positioned adjacent the signal contacts provided by the wafer set so as to form a ground, signal, signal, ground configuration of the contacts in the card slot; and wherein the wafer set is a first wafer set, the connector further including a second wafer set configured like the first wafer set, the second wafer set have a third shield plate on a first side and a fourth shield plate on a second side, wherein the second shield plate and the third shield plate are adjacent each other so as to provide a ground, signal, signal, ground, ground, signal, signal, ground arrangement of contacts in a row in the card slot, and wherein an air gap is provided between the second shield plate and the third shield plate.

2. The connector of claim 1, wherein the shields are commoned along a bottom edge.

3. The connector of claim 1, wherein each of the differential pairs are configured to support a data rate of 10 Gbps in a non-return to zero (NRZ) encoding.

4. The connector of claim 1, wherein the tails of the first shield plate are positioned forward of the signal terminals and the tail of the second shield plate side positioned rearward of the signal terminals so that the ground, signal, signal, ground tail arrangement is along an angled line.

5. The connector of claim 1, wherein each of the tails of the signal terminals that form the corresponding differential pair diverge so that they are spaced apart in a first direction and wherein each of the two ground shields that are positioned on opposite sides of the two signal wafers each include a tail associated with each differential pair so that the two ground shields provide a pair of tails associated with each differential pair.

6. The connector of claim 1, wherein the contacts in the card slot are on a 0.5 mm pitch.

7. A connector, comprising:

a housing with a card slot, the card slot having a first side and a second side;

a wafer set supported by the housing, the wafer set having a first and second wafer, each of the first and second wafers including a first terminal with a contact, a tail and a body extending therebetween, the contacts being positioned in the card slot on the first side, wherein the first terminals are aligned with each other and are configured to provide a first differential pair, the first terminals being configured to be coupled together in a broad-side manner;

a first shield plate on a first side of the wafer set, the first shield plate having a first ground terminal formed in the shield plate, the first ground terminal aligned with the first differential pair and having a ground contact and a first ground tail; and a second shield plate on a second side of the wafer set, the second shield plate having a second ground terminal formed in the shield plate, the second ground terminal aligned with the first differential pair and having a ground contact and a second ground tail, wherein the connector includes a second card slot and four wafer sets, each wafer set supporting four differential pairs and including a first and second shield plate provided on opposite sides of the wafer set, wherein the connector includes a perimeter defined by its tails and the connector is configured to provide back routing on four layers without requiring traces to extend beyond the perimeter.

8. The connector of claim 7, wherein the first differential pair is configured to support a data rate of 10 Gbps in a non-return to zero (NRZ) encoding.

9. The connector of claim 8, wherein the terminals in the card slot are on a 0.5 mm pitch.

10. A connector, comprising:

a housing with a card slot, the card slot having a first side and a second side;

a wafer set supported by the housing, the wafer set having a first and second wafer, each of the first and second wafers including a first terminal with a contact, a tail and a body extending therebetween, the contacts being positioned in the card slot on the first side, wherein the first terminals are aligned with each other and are configured to provide a first differential pair, the first terminals being configured to be coupled together in a broad-side manner;

a first shield plate on a first side of the wafer set, the first shield plate having a first ground terminal formed in the shield plate, the first ground terminal aligned with the first differential pair and having a ground contact and a first ground tail; and a second shield plate on a second side of the wafer set, the second shield plate having a second ground terminal formed in the shield plate, the second ground terminal aligned with the first differential pair and having a ground contact and a second ground tail, wherein ground contacts extend a first distance into the card slot and the signal terminals extend a second distance into the card slot, the first and second distance being different.

11. The connector of claim 7, further comprising a common bar, the common bar extending between the tails that form the differential pair and electrically coupling the first shield plate to the second shield plate.

12. The connector of claim 7, wherein the terminals in the card slots are on a 0.5 mm pitch.

13. The connector of claim 7 wherein the first ground tail, the two signal tails and the second ground tail are configured to be press-fit into vias on a supporting circuit board and are aligned so that in operation an imaginary line intersects four vias configured to receive the tails, wherein the tails are in a ground, signal, signal, ground configuration.

14. A connector system comprising:

a connector as defined by claim 7; and a circuit board having a plurality of vias arranged in rows.

15. The connector system of claim 14, wherein the connector includes a common bar that electrically connects the first shield plate to the second shield plate.

* * * * *